US006295930B1

(12) United States Patent
Kume et al.

(10) Patent No.: US 6,295,930 B1
(45) **Date of Patent: *Oct. 2, 2001**

(54) CIRCUIT BREAKER

(75) Inventors: Masahiro Kume; Motonori Kido; Yoshiyuki Miyazaki; Hideaki Toyama; Akio Matsumaru, all of Nagoya; Jun Yasukuni, Yokkaichi; Kenjiro Nishida; Junya Amano, both of Himeji; Ayumu Kimura; Hiroshi Hori, both of Himeji; Mitsuru Tanigawa, Yokkaichi, all of (JP)

(73) Assignees: Harness System Technologies Research, Ltd., Nagoya; Sumitomo Wiring Systems, Ltd., Yokkaichi; Sumitomo Electric Industries, Ltd., Osaka; Nippon Kayaku Kabushiki Kaisha, Tokyo, all of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/222,360

(22) Filed: Dec. 29, 1998

(30) Foreign Application Priority Data

| | | |
|---|---|---|
| Jan. 8, 1998 | (JP) | 10-002361 |
| Oct. 28, 1998 | (JP) | 10-307612 |
| Nov. 6, 1998 | (JP) | 10-315622 |

(51) Int. Cl.[7] ..... F42B 3/12

(52) U.S. Cl. ..... 102/202.5; 102/202.5

(58) Field of Search ..... 102/202.5

(56) References Cited

U.S. PATENT DOCUMENTS

| | | | | |
|---|---|---|---|---|
| 2,981,186 | * | 4/1961 | Stresau | 102/202.5 |
| 2,986,090 | * | 5/1961 | Doerpinghaus | 102/202.5 |
| 3,196,041 | * | 7/1965 | McNulty et al. | 102/202.5 |
| 3,793,920 | * | 2/1974 | Sheran | 86/1 |
| 3,850,101 | * | 11/1974 | Sower | 102/46 |
| 3,873,786 | | 3/1975 | Lagofun . | |
| 4,170,922 | * | 10/1979 | Peterson et al. | 89/7 |
| 4,331,078 | * | 5/1982 | Habbel et al. | 102/202.11 |
| 5,044,278 | * | 9/1991 | Campbell | 102/202.8 |
| 5,070,787 | * | 12/1991 | Weldon et al. | 102/216 |
| 5,385,098 | * | 1/1995 | Lindqvist et al. | 102/205 |
| 5,990,572 | * | 11/1999 | Yasukuni et al. | 307/10.1 |

FOREIGN PATENT DOCUMENTS

| | | |
|---|---|---|
| 83 03 559 | 8/1983 | (DE) . |
| 979854 | 1/1965 | (GB) . |
| B2-58-47809 | 10/1983 | (JP) . |
| 10-55742 | 2/1998 | (JP) . |
| WO 89/07233 | 8/1989 | (WO) . |

* cited by examiner

*Primary Examiner*—Charles T. Jordan
*Assistant Examiner*—Lulit Semunegus
(74) *Attorney, Agent, or Firm*—Oliff & Berridge, PLC

(57) ABSTRACT

A circuit breaker includes, a cylindrical portion having a gunpowder and a exploding unit for exploding the gunpowder by application of electric power to the gunpowder, the cylindrical portion being provided with an opening at at least one end; a base material securing the cylindrical portion, at least the surface of which is made of insulating material; a conductor fixed to the base material and having a break portion located at a position opposite to the opening of the cylindrical portion, the break portion being broken by explosive force of the gunpowder; a first metallic cover portion covering the cylindrical portion and the break portion; and a second metallic cover portion covering the base material from an opposite side to the cylindrical portion, wherein the first and second cover portions are fixed to the base material by directly connecting the first and second cover portions each other.

30 Claims, 18 Drawing Sheets

CIRCUIT BREAKER

BACKGROUND OF THE INVENTION

1. Field of the Invention

The present invention relates to a circuit breaker incorporated into an automobile and others.

2. Description of the Related Art

In general, in the electric circuit incorporated into an automobile, it is common to use a fuse or fusible link as a means for quickly shutting off the electric circuit when an overcurrent or a short circuit current flows in the electric circuit. Basically, these fuse and fusible link are composed in such a manner that a fusible conductor is arranged in a case and that a terminal for connection is arranged on the outside of this case. In many cases, these fuse and fusible link are put into practical use being connected with an electric connection box.

However, the above fuse and fusible link are fused for the first time when an overcurrent flows in the electric circuit and the electric circuit is shut off. Therefore, it is impossible to forcibly shut off the electric circuit at an arbitrary time. Accordingly, in case of emergency, for example, when an automobile accident has occurred, it becomes necessary to forcibly shut off an electric circuit for the purpose of safety even if no overcurrent flows in the electric circuit. Therefore, instead of the above fuse and fusible link, or in addition to the above fuse and fusible link, it is necessary to provide a circuit breaker for forcibly shutting off the electric circuit by operation conducted from the outside.

In order to provide the above circuit breaker, as disclosed in Japanese Examined Patent Publication No. 58-47809, it is possible to use a circuit breaker by which a conductor incorporated into the circuit is broken by explosive force of gunpowder. This circuit breaker is composed as follows. An output fuse, gunpowder and filament to heat the gunpowder are enclosed in a single sealed glass case, and an input terminal connected with the filament is led outside the sealed glass case in such a manner that the input terminal penetrates the sealed glass case. A surface of this sealed glass case is covered with an explosion-proof coat.

According to the above circuit breaker, when the input terminal is given an electric current or voltage, the intensity of which is not lower than a predetermined value, and the filament is heated, the gunpowder is exploded by the heat generated in the filament. Therefore, it is possible to forcibly break the conductor by the explosive force. Accordingly, in case of emergency, for example, when an automobile accident has occurred, it is possible to shut off the circuit at any time by controlling an input current or input voltage given to the input terminal.

However, according to the circuit breaker disclosed in the above patent publication, the explosive power of gunpowder is dispersed in the sealed glass case in all directions, and only one portion of the explosive power acts on the output fuse. Therefore, a considerably high intensity of explosive power is required for breaking the fuse positively. However, when the intensity of explosive power is enhanced by increasing a quantity of gunpowder, the inside of the sealed glass case is given a high intensity of explosive force. Therefore, the sealed glass case must have a strong structure so that it can withstand the high intensity of explosive power. Further the sealed glass case must be made of expensive material or it must be subjected to a special treatment for enhancing the mechanical strength. Accordingly, the manufacturing cost is inevitably increased.

On the other hand, a great task to be accomplished is the prevention of dispersion of broken pieces of the inner structure including the conductor.

Further, Japanese Unexamined Patent Publication No. 10-55742 discloses a related circuit breaker. The circuit breaker disclosed in the above patent publication is described as follows. A conductor for composing a circuit is arranged in a case, and an explosion unit for exploding gunpowder is arranged below the conductor. In the case of emergency, the explosion unit is operated, so that the conductor is exploded. Due to the foregoing, the circuit can be quickly and forcibly shut off.

In the above circuit breaker, when the case is tightly shielded up, there is a possibility that the pressure in the case is increased too high by the action of gas generated in the explosion of gunpowder, and further it becomes difficult for the temperature in the case to be lowered. For the above reasons, it is preferable to provide vent holes on the case. However, when the vent holes are provided as described above, not only gas but also flames are dispersed from the vent holes to the outside, which has a bad influence on parts arranged in the peripheral portion. According to the related arrangement, in order to prevent the flames from dispersing from the vent holes to the outside, the case must be covered with a sufficiently large cover, the mechanical strength of which is high, or alternatively the size of the case itself must be increased. Therefore, it is difficult to reduce the overall size and weight of the circuit breaker.

SUMMARY OF THE INVENTION

In view of the above circumstances, the present invention has been accomplished. It is an object of the present invention to provide a circuit breaker, which the explosive power of gunpowder is made to act on a break portion effectively, and emergency shutoff can be safely and positively conducted by a simple and compact structure of low cost; and dispersion of pieces of the inner structure caused by the explosion can be positively prevented.

To solve the above-described object, the present invention is characterized by the following features.

(1) A circuit breaker includes:

a cylindrical portion having a gunpowder and a exploding unit for exploding the gunpowder by application of electric power to the gunpowder, the cylindrical portion being provided with an opening at at least one end;

a base material securing the cylindrical portion, at least the surface of which is made of insulating material;

a conductor fixed to the base material and having a break portion located at a position opposite to the opening of the cylindrical portion, the break portion being broken by explosive force of the gunpowder;

a first metallic cover portion covering the cylindrical portion and the break portion; and a second metallic cover portion covering the base material from an opposite side to the cylindrical portion, wherein the first and second cover portions are fixed to the base material by directly connecting the first and second cover portions each other.

In the above structure, when the exploding unit in the cylindrical portion is operated and gunpowder is exploded, the explosive power concentrates on the break portion of the conductor which is arranged at a position close to the opening of the cylindrical portion. Due to the above structure, the break portion can be positively broken even if a small quantity of gunpowder is used. Since the break portion and the cylindrical portion are covered with the first cover portion made of metal, the mechanical strength of which is relatively high, there is no possibility that pieces of the inner structure are dispersed outside the circuit breaker.

On the assumption that the second cover portion is not provided and only the first cover portion is fixed to the base material, the following problems may be encountered. The base material to which the first cover portion is fixed is broken by the above explosive power, and the first cover portion is separated from the base material, that is, the first cover portion is disconnected from the base material. Therefore, even if the mechanical strength of the first cover itself is high, it is difficult to prevent pieces of the inner structure from dispersing. However, according to the structure of the present invention, in addition to the first cover portion, the second cover portion made of the same metal as that of the first cover portion is arranged in such a manner that the second cover portion covers the base material from an opposite side to the cylindrical portion and the break portion. Further, both cover portions are directly connected with each other. In other words, both cover portions are arranged in such a manner that the base material is interposed between both cover portions from the front and the reverse side. Due to the above structure, even if a high intensity of explosive power is given to both cover portions, there is no possibility that both cover portions are disconnected from the base material. Accordingly, pieces of the inner structure can be positively prevented from dispersing.

(2) The circuit breaker according to (1), wherein the first and second cover portions are integrally formed.

According to the above structure, the number of parts can be decreased, and the cost can be reduced.

(3) The circuit breaker according to (2), wherein the first cover portion has a pair of side walls, the second cover portion is composed of a pair of rolling portions extending from the side walls, and the first and second cover portions are fixed to the base material by rolling the rolling portions on the opposite side of the base material so that the rolling portions are lapped each other while interposing the base material.

According to the above structure, the first and the second cover portion can be fixed by a simple assembling work.

(4) The circuit breaker according to (1), wherein a recess portion accommodating the second cover portion is formed on the base material.

According to the above structure, even if both cover portions are made to be members different from each other, the second cover portion is engaged with the recess portion so that the first and the second cover portions are directly connected with each other. Therefore, it is possible to compose the circuit breaker in a compact structure.

(5) The circuit breaker according to (1), wherein insulating material is provided on the inside of the first cover portion.

The cylindrical portion and the break portion may be covered with only the first cover portion. However, in this case, when the break portion directly comes into contact with the first cover portion made of metal after explosion, there is a possibility of occurrence of short circuit. According to the above structure, the break portion is not directly contacted with the first cover portion, and the occurrence of short circuit can be positively prevented.

(6) The circuit breaker according to (1), wherein an inner surface of the first cover portion is coated with insulating material.

According to the above structure, it possible to reduce the number of parts.

(7) The circuit breaker according to (1), wherein a cover made of resin is molded so as to cover a connecting portion of the base material with each cover portion.

According to the above structure, it is possible to keep the connection in a good condition, and it is possible to positively prevent each cover from being disconnected from the base material. That is, it is possible to more positively prevent pieces of the inner structure from dispersing. Further, the appearance can be enhanced.

(8) The circuit breaker according to (1), wherein the base material is made of one of aluminum and aluminum alloy, the surface of which is oxidized to form its oxide layer.

(9) A circuit breaker includes:

a cylindrical portion having a gunpowder and an exploding unit for exploding the gunpowder by application of electric power to the gunpowder, the cylindrical portion being provided with an opening at at least one end;

a base material securing the cylindrical portion, at least the surface of which is made of insulating material;

a conductor fixed to the base material and having a break portion located at a position opposite to the opening of the cylindrical portion, the break portion being broken by explosive force of the gunpowder; and a metal cover portion fixed to the base material so as to cover the cylindrical portion and the break portion;

wherein the base material is made of one of aluminum and aluminum alloy, the surface of which is oxidized to form its oxide layer.

When at least the surface of the base material has the insulating property, it is possible to avoid the occurrence of short circuit. According to the above structure, the mechanical strength of the base material itself is considerably high unlike a base material entirely made of insulating material such as synthetic resin. Accordingly, it is possible to omit the second cover portion in this case, and only when the cover portion which covers the cylindrical portion and the break portion is fixed to the base plate, it is possible for the device to withstand explosive power.

(10) The circuit breaker according to (9), wherein insulating material is provided on the inside of the cover portion.

(11) The circuit breaker according to (9), wherein an inner surface of the cover portion is coated with insulating material.

(12) The circuit breaker according to (9), wherein a cover made of resin is molded so as to cover a connecting portion of the base material with the cover portion.

(13) A circuit breaker includes:

an ignition part enclosing a gunpowder; and an electric path having a break portion broken by an explosive force of the gunpowder so as to shut off electric current applied thereon, wherein a space formed between an ignition point of the ignition part and the break portion of the electric path is tightly closed.

In the above arrangement, when gunpowder is exploded, all the explosive force is effectively sent from the tightly closed space to the break portion of the electric path. Therefore, the explosive force concentrates on the break portion. Accordingly, even an electric path, the cross-sectional area of which is large because a high intensity of electric current is made to flow in the electric path, can be positively broken by a small quantity of gunpowder. Consequently, it is possible to make a high intensity of electric current flow in an electric path, the cross-sectional area of which is large. In this case, gunpowder includes explosive. It is preferable that a volume of the tightly closed space is small.

(14) The circuit breaker according to (13), further includes:

a case having the electric path and the ignition part, wherein the electric path is bent into a substantially U-shape so as to center the break portion, the electric path is fitted into the case along an inner surface of the case from the break portion side, and the ignition part is fitted into the U-shaped portion of the electric path and the case along the inner surfaces of the U-shaped portion and the case from the ignition point side of the ignition part, whereby a tightly closed space can be formed between the ignition part and the break portion such that the ignition point is opposed to the break portion.

(15) The circuit breaker according to (14), wherein the U-shaped portion of the electric path is formed into the same shape as that of the inside of the case.

(16) The circuit breaker according to (14), wherein a packing member for tightly closing the tightly closed space is provided in at least one of portions in which the case, electric path and ignition part are fitted with each other.

(17) The circuit breaker according to (13), wherein the gunpowder of the ignition part includes metal.

(18) The circuit breaker according to (17), wherein the metal is made of at least one material selected from at least one of a first group and a second group, the first group consisting of metal element of B, Ti, Fe, Co, Ni, Cu, Zn, Al, Si, Ga, Ge, Sn, Mo, Zr and W, the second group consisting of an alloy made of B, Ti, Fe, Co, Ni, Cu, Zn, Al, Si, Ga, Ge, Sn, Mo, Zr and W.

(19) A circuit breaker to shut off electric current by breaking an electric path by an explosive force of a gunpowder, wherein the gunpowder contains metal.

In the above structure, the metal functions as a metal jet in the case of ignition. Therefore, the break portion can be positively broken.

(20) A circuit breaker includes:

a case accommodating a conductor for composing a circuit, the conductor being broken by an explosive force of a gunpowder so as to forcibly shut off the circuit;

a gas discharge path discharging gas generated by the explosion from the case to the outside of the circuit breaker; and a porous body filled in the gas discharge path and suppressing the propagation of a flame while it allows gas to pass through.

According to the above structure, gas generated in the process of explosion of gunpowder can be quickly discharged to the outside of the case, and further the propagation of a flame to the outside can be suppressed by the porous body.

(21) The circuit breaker according to (20), wherein the porous body is composed of metallic meshes.

(22) The circuit breaker according to (20), wherein the gas discharge path has a longitudinal portion extending in a direction substantially perpendicular to the direction of gas generation in the explosion, and at least a part of the longitudinal portion is filled with the porous body.

In the above structure, the propagation of a flame to the outside can be positively prevented as compared with an arrangement in which the gas discharge path is directed to the same direction as that of gas generation.

(23) The circuit breaker according to (22), wherein the porous body is filled in a substantially entire region of the longitudinal portion of the gas discharge port.

In the above structure, the propagation of a flame to the outside can be more positively suppressed.

(24) The circuit breaker according to (20), wherein a gas discharge port is formed on the case, the gas discharge path is composed of a substantially cylindrical path forming member having a longitudinal portion extending from the gas discharge port to a direction substantially perpendicular to a direction which gas is discharged, and attached to the case so as to close the gas discharge port, and at least a part of the longitudinal portion is filled with the porous body.

In the above structure, it is easy to fill the porous body and further it is possible to use an existing case.

(25) The circuit breaker according to (24), wherein the porous body is filled at a position opposed to the gas discharge port.

In the above structure, the pressure of generated gas can be dispersed by the porous body. Therefore, mechanical loads given to the path forming member and the case can be advantageously reduced.

(26) The circuit breaker according to (24), wherein the porous body is filled in a substantially entire region of the longitudinal portion of the gas discharge port.

(27) The circuit breaker according to (25), wherein the porous body is filled in a substantially entire region of the longitudinal direction of the gas discharge port, the porous body is defined with a recess fitting an end portion of the case on the side, on which the gas discharge port is arranged.

In the above structure, it is possible to reduce the size in the engaging direction and the entire circuit breaker can be made compact while the function of preventing the propagation of a flame is kept high.

DETAILED DESCRIPTION OF THE PREFERRED EMBODIMENTS

Referring to FIGS. 1 to 5, a first embodiment of the present invention will be explained below.

Figure 1:
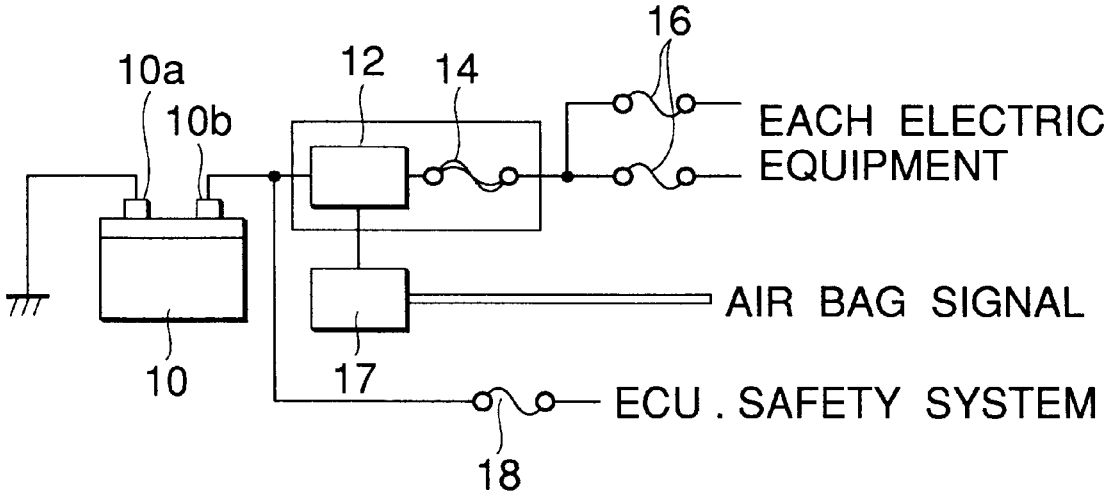
FIG. 1 is a view showing an electric power supply circuit for automobile use having a circuit breaker of the present invention.

FIG. 1 is a view showing an example of the electric power supply circuit for automobile use into which the circuit breaker of the present invention is incorporated. In the figure, a negative terminal 10*a* of the battery 10 is grounded, and a positive terminal 10*b* is connected to each electrical equipment mounted on an automobile via the circuit breaker 12 of the present invention, the fusible link 14 and the fuses 16 of small capacity arranged in parallel with each other. Further, this automobile is provided with harness ECU (harness control unit) 17. This harness ECU outputs a control signal into the above circuit breaker 12 when an air bag signal is inputted into it (when an automobile collision is detected), and this circuit breaker 12 is forcibly shut off. Electric devices for safety use such as a drive circuit for driving a room lamp and a hazard lamp for emergency, a device for releasing a door lock, and another ECU are connected to the battery 10 not via the circuit breaker 12 but via only the fuse 18. Due to the above arrangement, even after-the circuit has been shut off by the above circuit breaker 12, electric power can be supplied to the electric devices for safety use.

Next, a specific structure of the circuit breaker 12 will be explained below referring to FIGS. 2 to 5.

The circuit breaker 12 shown in the drawing includes a substantially rectangular parallelepiped base material 20 made of insulating material. At the center on the upper surface of this base material 20, there is provided a cylindrical portion 22 which is vertically attached to the base material 20 with the bracket 24 made of insulating material. This cylindrical portion 22 is open upward and houses a predetermined quantity of gunpowder and a filament for heating the gunpowder. This filament is connected to harness ECU 17 via the lead wire 28 and heated when an electric current flows in the filament according to a control signal sent from harness ECU 17.

Figure 2:
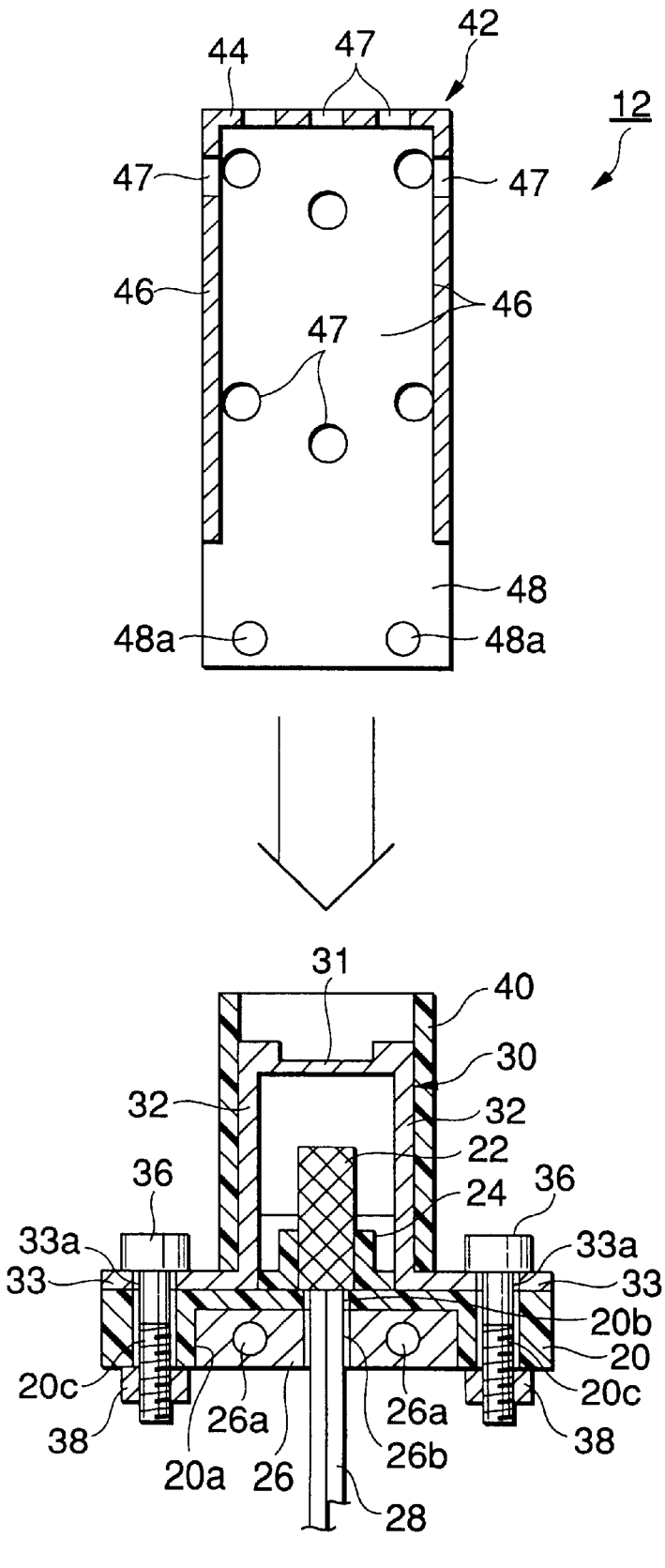
FIG. 2 is a cross-sectional front view showing a main body and a cover cap of the circuit breaker of the first embodiment of the present invention.

At the center in the lower portion of the base material 20, there is formed a recess portion 20*a* which is open in the longitudinal direction (in the direction perpendicular to the surface of FIG. 2). In this recess 20*a*, there is provided a cover bottom plate (second cover portion) 26 made of metal. In this cover bottom plate 26, there are formed a pair of bolt insertion holes 26*a* which penetrate the cover bottom plate 26 in the longitudinal direction. At the center of the cover bottom plate 26, there is formed a lead wire insertion hole 26*b* which penetrates the cover bottom plate 26 in the vertical direction. In a portion of the base material 20 immediately above the lead wire insertion hole 26*b*, there is formed a lead wire insertion hole 20*b*. The lead wire 28 is led outside the circuit breaker from the cylindrical portion 22 via both lead wire insertion holes 20*b*, 26*b*.

A conductor 30 composing a portion of the circuit shown in FIG. 1 is fixed onto the base material 20. This conductor 30 includes: a horizontal break portion 31; a pair of vertical wall portions 32 extending downward from both ends of this break portion 31; and connecting terminal portions 33 extending outside from both ends of the vertical wall portions 32.

This break portion 31 is designed in this embodiment as follows. Width of this break portion 31 is small. Therefore, even when a low intensity of explosive power is given to the conductor 30, the break portion 31 can be broken, and this break portion 32 functions as a fusible link in this embodiment capable of fusing by the heat generated due to electric resistance when an overcurrent flows in the circuit. That is, this conductor 30 is made of the same material as that used for a commonly used fuse. However, it should be noted that the break portion 31 is not necessarily provided with the fuse function.

Figure 3A:
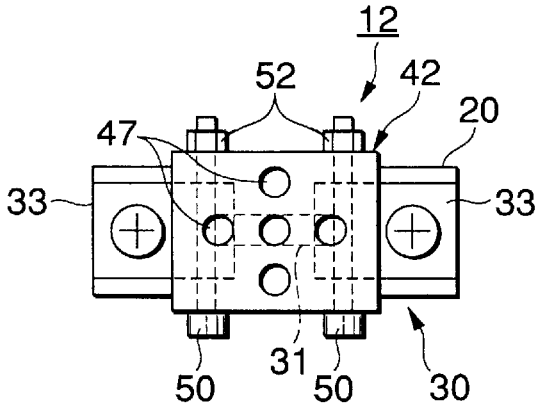
FIG. 3A is a top view of the circuit breaker of the first embodiment.
Figure 3B:
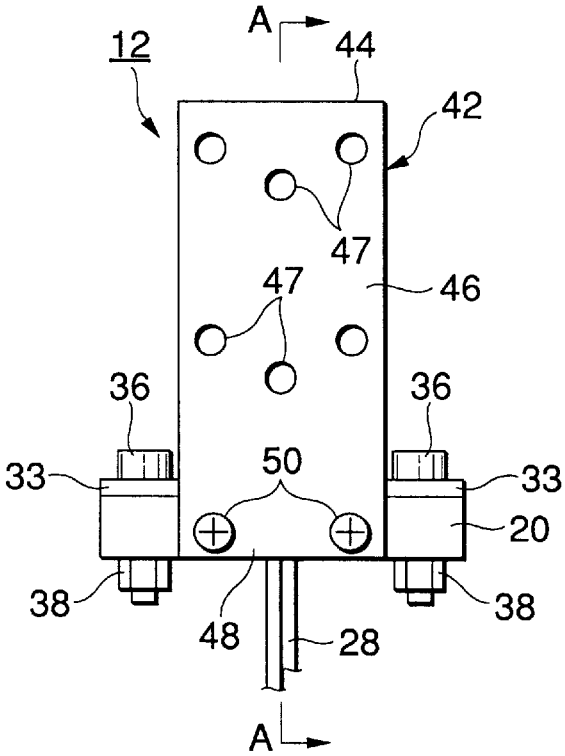
FIG. 3B is a front view of the circuit breaker of FIG. 3A.
Figure 3C:
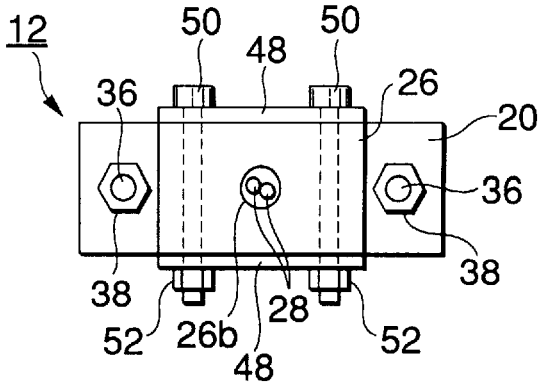
FIG. 3C is a bottom view of the circuit breaker of FIG. 3A.
Figure 4:
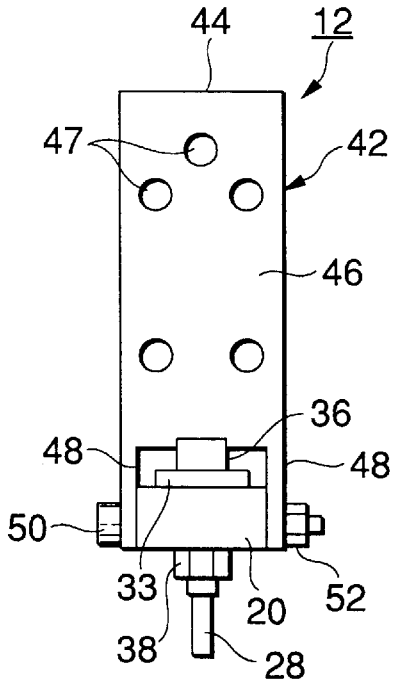
FIG. 4 is a side view of the circuit breaker of the first embodiment.
Figure 5:
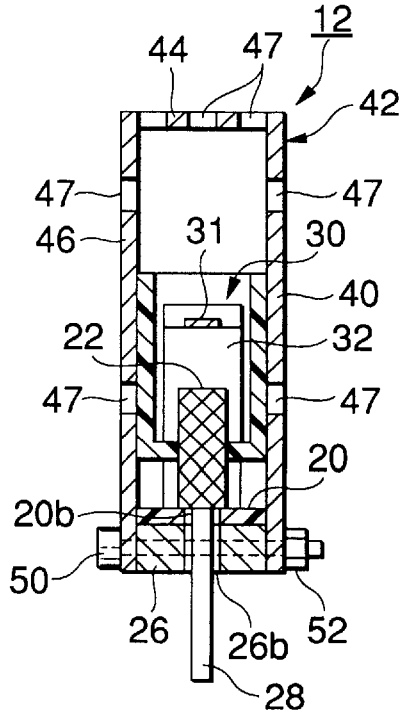
FIG. 5 is a cross-sectional view taken along line A—A in FIG. 3B.
Figure 6:
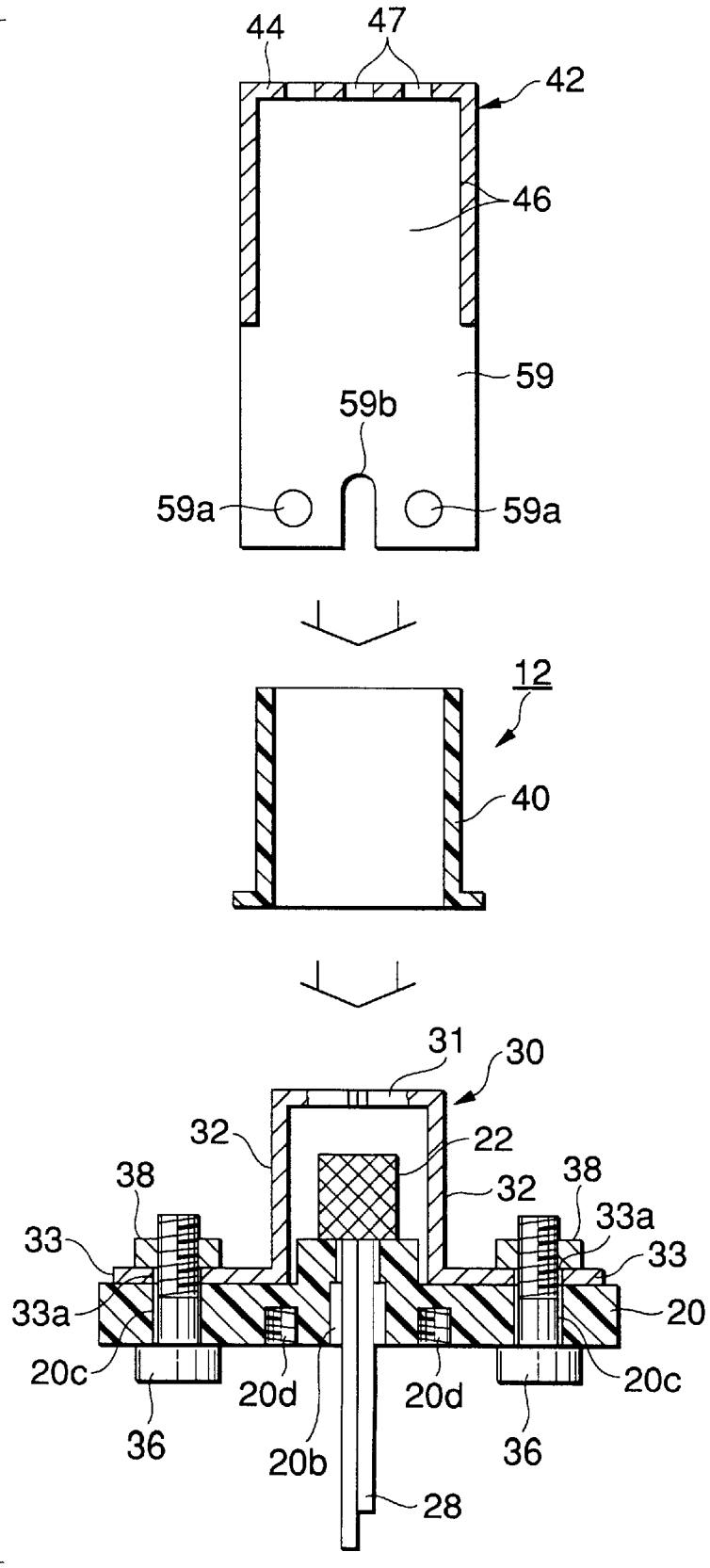
FIG. 6 is a cross-sectional front view showing a main body of the circuit breaker, an insulating cover and a cover cap of the second embodiment of the present invention.
Figure 7A:
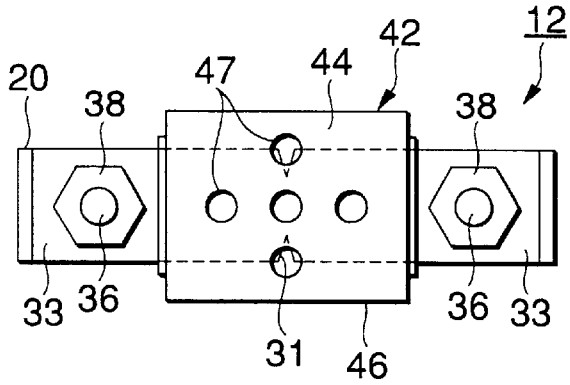
FIG. 7A is a top view of the circuit breaker shown in FIG. 6.
Figure 7B:
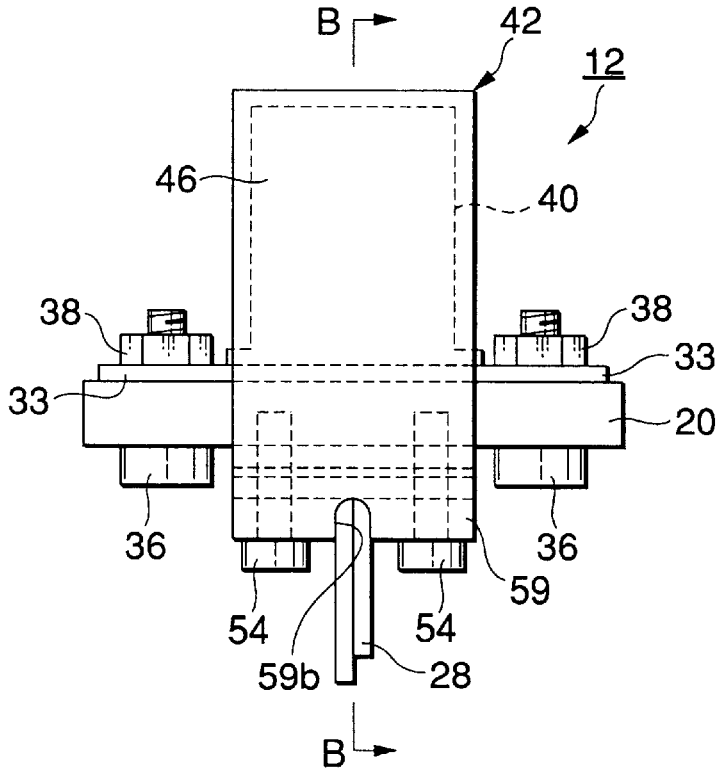
FIG. 7B is a front view of the circuit breaker of FIG. 7A.
Figure 7C:
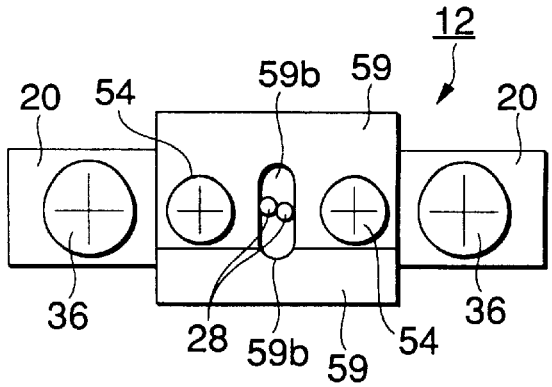
FIG. 7C is a bottom view of the circuit breaker of FIG. 7A.
Figure 8:
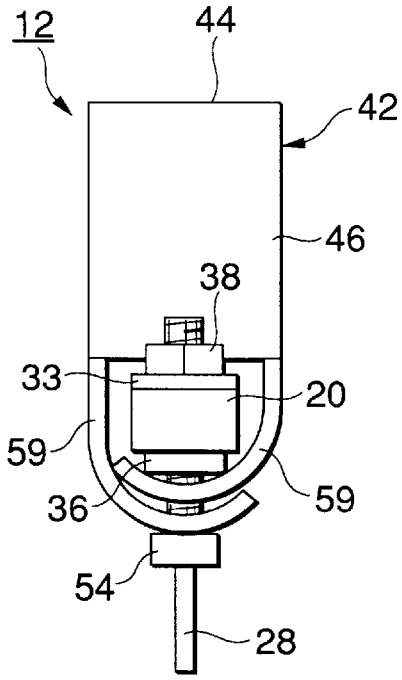
FIG. 8 is a side view of the circuit breaker shown in FIG. 6.
Figure 9:
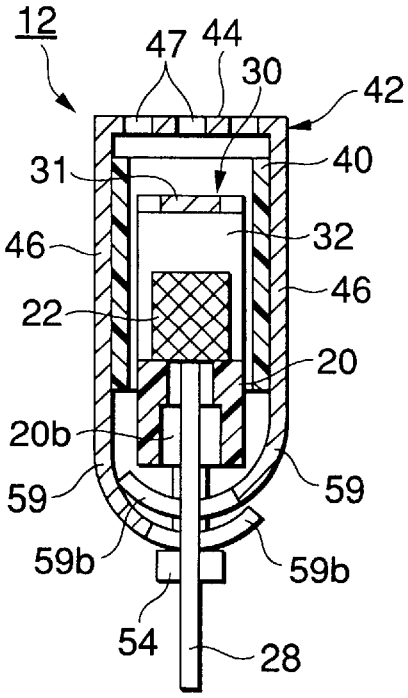
FIG. 9 is a cross-sectional view taken along line B—B in FIG. 7B.

Both connecting terminals 33 are provided with bolt insertion holes 33*a*. In the same manner, both end portions of the base material 20 are provided with bolt insertion holes 20*c* penetrating the base material 20 vertically. When bolts 36 are inserted into the bolt insertion holes 33*a*, 20*c* and fastened with nuts 38, both connecting terminals 33 are fixed to the base material 20. In the above fixing state, the entire profile of the conductor 30 is set so that the break portion 31 crosses a position immediately above the cylindrical portion 22 as shown in FIG. 2 and 3A. One connecting terminal 33 is electrically connected to the positive terminal 10*b* of the battery 10 shown in FIG. 1, and the other connecting terminal 33 is electrically connected to the fusible link 14 shown in FIG. 1.

There is provided a cylindrical insulating cover 40 outside the conductor 30 so that the conductor 30 can be covered with the cylindrical insulating cover 40. Further, there is provided a cover cap (first cover portion) 42 made of metal outside the cylindrical insulating cover 40. This cover cap 42 includes: an upper wall 44 for covering the cylindrical portion 22 and the break portion 31 from above; and side walls 46 for covering the cylindrical portion 22 and the break portion 31 from the sides. On these upper wall 44 and the side walls 46, there are formed vent holes 47 by which an increase of inner pressure can be prevented in the case of explosion.

A pair of extending walls 48 are extended from the side walls 46 located in the front and at the rear. A pair of bolt insertion holes 48*a* are formed at the lower end of each extending wall 48. A bolt 50 is inserted into each bolt insertion hole 48*a* and the bolt insertion hole 26*a* of the cover bottom plate 26 and fastened with a nut 52. Due to the foregoing, the cover cap 42 and the cover bottom plate 26 are directly fastened to each other.

As long as the material of the above base material 20 and the insulating cover 40 has the insulating property, any material may be used. For example, ceramics may be used. However, it is preferable to use light synthetic resin which can be easily molded, for example, it is preferable to use heat-resistant and highly strong resin such as polyacetal, nylon resin containing glass and PPS resin.

The cover cap 42, which is a cover portion, and the cover bottom plate 26 may be made of metal, the mechanical strength of which is relatively high, however, it is preferable that they are made of stainless steel such as SUS304 and others.

Next, operation of this circuit breaker of the first embodiment will be explained as follows.

When an air bag signal is made by a collision between automobiles and inputted into harness ECU 17, an electric current is made to flow by harness ECU 17 in the filament arranged in the cylindrical portion 22 via the lead wire 28. Therefore, the filament is heated and explodes gunpowder accommodated in the cylindrical portion 22. This explosive power is concentrated upon the break portion 31 immediately above the cylindrical portion 22. Therefore, even if a quantity of gunpowder is small, it is possible t o break the break portion 31. Due to the foregoing, the electric power supply circuit shown in FIG. 1, into which the conductor 30 having the above break portion 31 is incorporated, is forcibly shut off. That is, electric power supply to substantially all electric devices except for some electric devices is shut off at the same time, and safety can be guaranteed after the collision.

Here, we assume that the cover bottom plate 26 made of metal is not provided and the cover cap 42 made of metal is only fixed to the base material 20 with bolts. In this case, even if the mechanical strength of the cover cap 42 is high, the mechanical strength of the base material 20 made of synthetic resin connected to the cover cap 42 is low. Therefore, there is a possibility that pieces of the inner structure (pieces of the break portion 31, which has been broken, and pieces of a portion of the cylindrical portion 22) are dispersed in such a manner that the base material 20 is broken by the explosive power and the cover cap 42 is disconnected from the base material 20. However, when the base material 20 is interposed between the cover cap 42 made of metal and the cover bottom plate 26 made of metal, and also when the cover cap 42 and the cover bottom plate 26 are directly fastened to each other with the bolts 50 as shown in the figure, even if the mechanical strength of the base material 20 is low, the fastening portion, in which the cover cap 42 and the cover bottom plate 26 are directly fastened to each other, is not broken. Therefore, these members are not disconnected from the base material 20, and dispersion of the inner structure can be positively prevented.

In this circuit breaker, the base material 20 is provided with a recess portion 20*a* in which the cover bottom plate 26 is engaged. Therefore, even if two cover members of the cover cap 42 and the cover bottom plate 26 are used, it is possible to make the circuit breaker compact.

Since the insulating cover 40 is interposed between the inner conductor 30 and the cover cap 42 and also between the cylindrical portion 22 and the cover cap 42, it is possible to prevent the break portion 31, which has been broken, from coming into contact with the cover cap 42, that is, it is possible to prevent the occurrence of short circuit.

[Second Embodiment]

Next, referring to FIGS. 6 to 9, a second embodiment will be explained as follows.

In this embodiment, the cover bottom plate 26 shown in the first embodiment is omitted, and rolling portions 59, which are longer than the extending wall portion 49 of the first embodiment, are extended downward from the front and the rear side wall 46 of the cover cap 42. At the center of each rolling portion 59 in the transverse direction, there is provided a U-shaped cutout 59*b* into which the lead wire is inserted, wherein the U-shaped cutout 59*b* is open to the forward end side of the rolling portion 59, that is, the U-shaped cutout 59*b* is open to the lower side in FIG. 6. On both sides of the cutout 59*b*, there are provided bolt insertion holes 59*a*. In the base material 20, instead of the recess portions 20*a*, into which the cover bottom plate is inserted, shown in the first embodiment, there are formed a pair of screw holes 20*d* which are open downward. Then, both rolling portions 59 are rolled on the lower side of the base material 20, that is, both rolling portions 59 are bent on the lower side of the base material 20, and both bolt insertion holes 59*a* and both lead wire insertion cutout portions 59*b* are lapped each other. The lead wires 28 connected to the cylindrical portion 22 are led out downward from these lead wire insertion cutout portions 59*b*. At the same time, the bolts 54 are inserted into both bolt insertion holes 59*a* and screwed into the screw holes 20*d* of the base material 20. Due to the foregoing, the rolling portions 59 can be connected to each other, and both rolling portions 59 can be fixed to the base material 20.

Also, in the above structure, the base material 20 is interposed between the main body of the cover cap 42, which is the first cover portion, and both rolling portions 59, which is the second cover portion, that is, the base material 20 is interposed from both the front and the rear side. Due to the above arrangement, even if the mechanical strength of the base material 20 is somewhat low, there is no possibility that the cover cap 42 is disconnected from the base material 20. Accordingly, it is possible to positively prevent the dispersion of pieces of the inner structure. Further, since the first cover portion and the second cover portion are composed of a single member (cover cap 42), the number of parts is small, and the manufacturing cost can be reduced.

[Third Embodiment]

Figure 10:
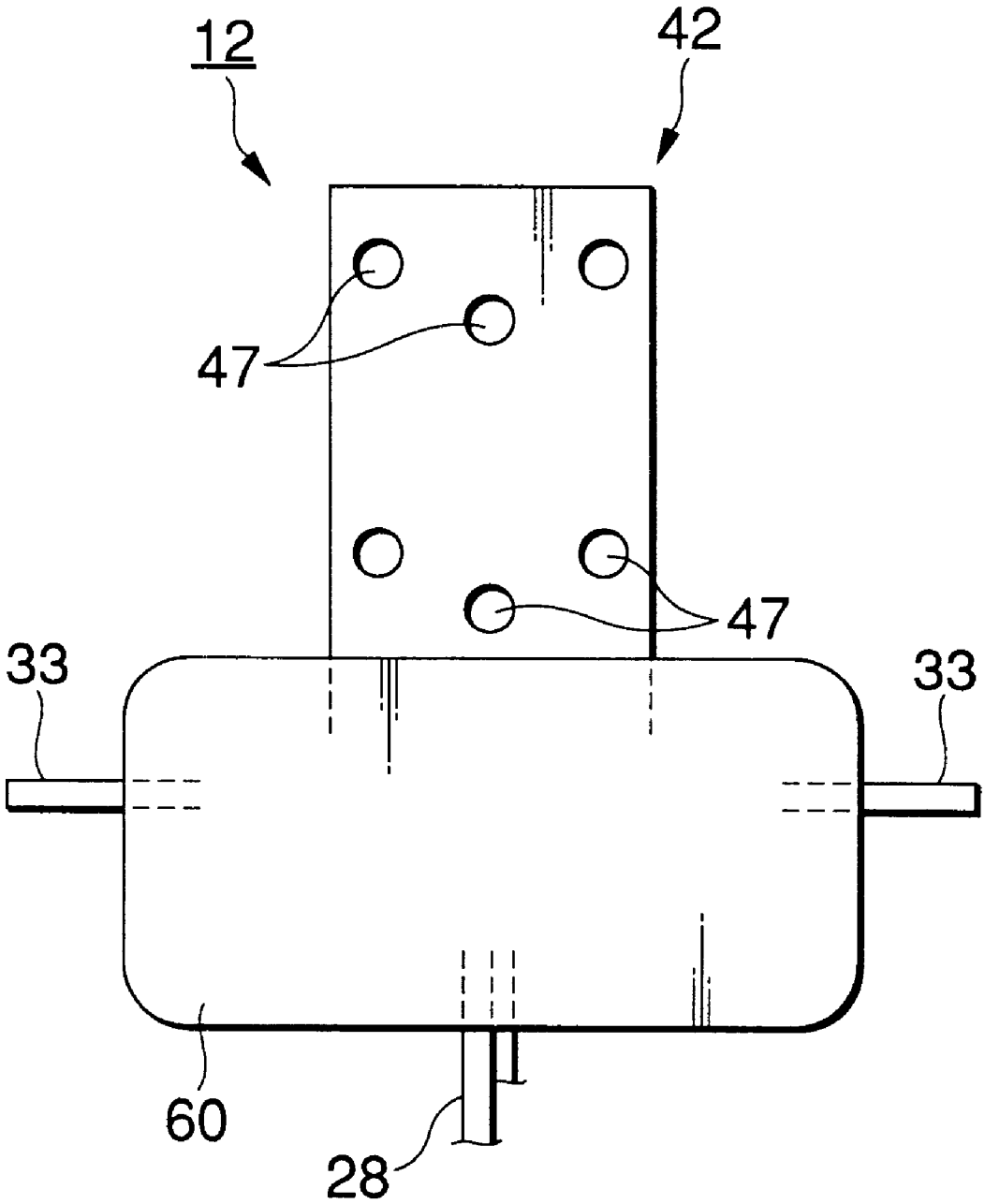
FIG. 10 is a front view showing a circuit breaker of the third embodiment of the present invention.

FIG. 10 is a view showing a third embodiment. This embodiment is composed as follows. In the circuit breaker 12 shown in the first embodiment, a resin cover 60 is molded so as to cover the base material 20, the cover bottom plate 26 and a lower end portion of the cover cap 42. Lengths of both connecting terminals 33 are sufficiently long so that both connecting terminals 33 can be protruded outside the resin cover 60.

Due to the above arrangement, the base material 20 can be fastened to the cover cap 42 and the cover bottom plate 26 in a good condition. Therefore, dispersion of pieces of the inner structure can be more positively prevented, and further the appearance can be enhanced.

In first to third embodiments described above, the entire base material 20 is made of insulating material. However, when at least the surface of the base material 20 is provided with the insulating property, it is possible to prevent the occurrence of short circuit. For example, the surface of a piece of aluminum or aluminum alloy may be subjected to anodic oxidation so as to form an oxide layer on the surface. This piece of aluminum or aluminum alloy may be used as the base material 20. In this case, the mechanical strength of the base material itself is considerably high. Therefore, the second cover portion (cover bottom plate 26 and rolling portion 59), which is shown in each embodiment described above, may be omitted, and only the first cover portion (cover cap 42) may be fixed to the base material 20. Even in the above structure, it is possible to prevent the dispersion of pieces of the inner structure.

In first to third embodiments described above, on the reverse side of the cover cap 42, there is provided the insulating cover 40 different from the cover cap 42. However, the reverse side of the cover cap 42 may be coated with insulating material. Even in this structure, it is possible to prevent the cover cap 42 made of metal from being short-circuited to the break portion 31 after explosion.

[Fourth Embodiment]

Next, referring to FIGS. 1 and 11–14, a fourth embodiment will be explaining as follows.

Figure 11:
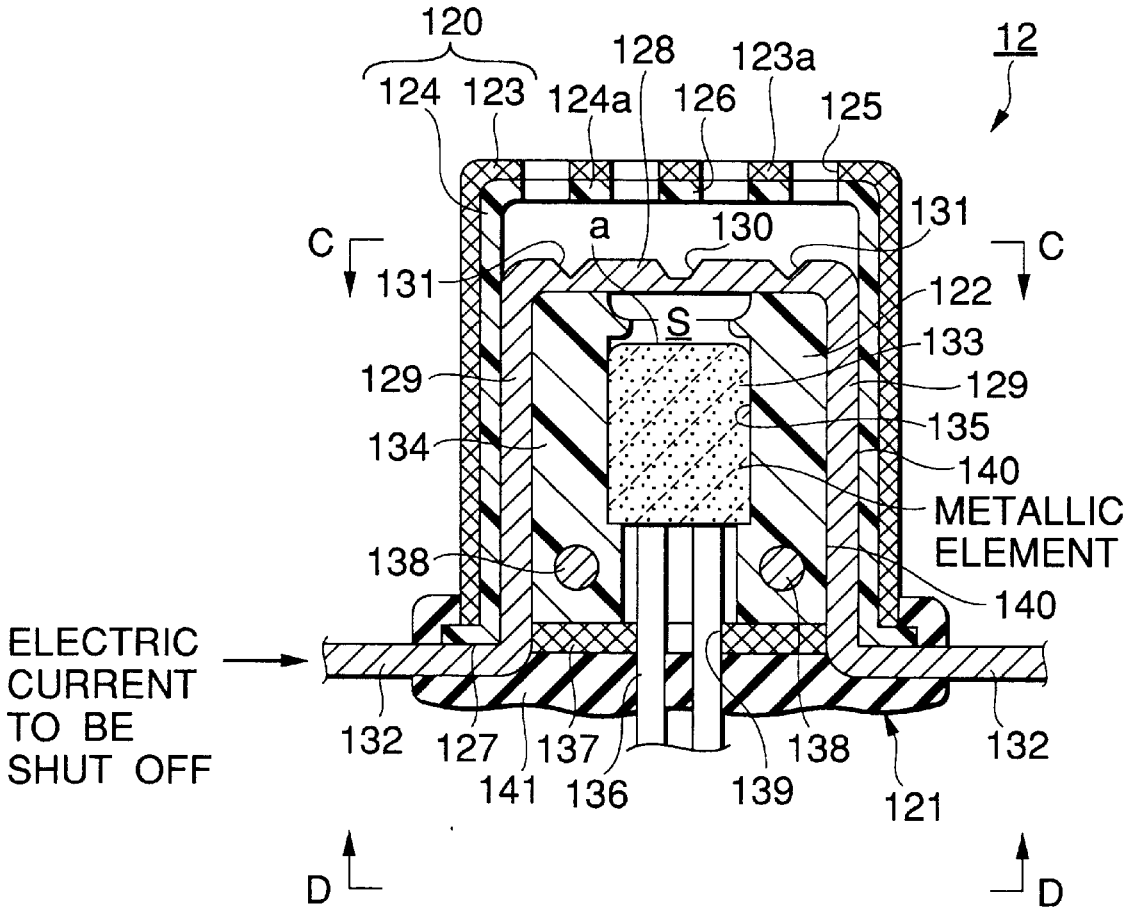
FIG. 11 is a longitudinally cross-sectional schematic illustration showing the circuit breaker of the fourth embodiment.
Figure 12:
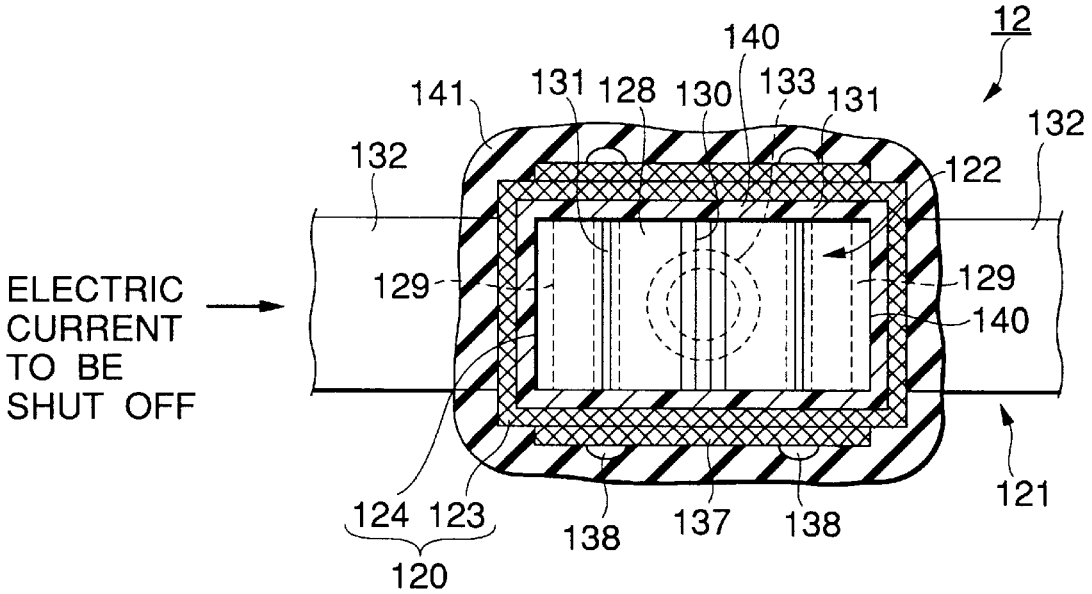
FIG. 12 is a cross-sectional view of the circuit breaker taken along line C—C in FIG. 11.

The circuit breaker 12 shown in FIGS. 11 and 12 is composed of a case 120, an electric path 121 accommodated in the case 120, and an ignition part 122.

The case 120 is composed of a box-shaped case body 123, one end of which is open, and an inner case 124 inserted into this case body 123. The case body 123 is integrally made of material, which can resist an explosive force breaking the electric path 121, for example, the case body 123 is integrally made of stainless steel such as SUS304 and other metal. At the bottom 123*a* of the case body 123, there are formed a plurality of opening holes 125 which communicate the inside of the case with the outside.

The inner case 124 is made of heat-resistant insulating material of high mechanical strength such as ceramics or synthetic resin (polyacetal, nylon resin containing glass and PPS resin) and formed into a shape of a cup which covers the inside of the case body 123. At the bottom 124*a* of this inner case 124, there are formed a plurality of communicating holes 126 which communicate the inside with the outside via the opening holes 125 of the case body 123. At the opening end of the inner case 124, there is provided a flange 127 which is bent so that it comes into contact with the opening edge of the case body 123.

The electric path 121 is composed of a plate member made of copper and formed into a U-shape. The electric path 121 includes a break portion 128 and two conductor portions 129 which are bent at both ends of the break portion 128. The break portion 128 is formed into the same rectangle as that of the inside shape (cross-sectional shape) of the case 120 (inner case 124), and inserted along the inside shape as shown in FIG. 12. The break portion 128 includes: a break groove 130, the wall thickness of which is small; and two bent grooves 131. The break groove 130 is formed at the center of the break portion 128, and the two bent grooves 131 are formed at positions distant from the break groove 130 by an appropriate distance on both sides of the break groove 130. Connection terminal portions 132 are respectively continued from the conductor portions 129 in such a manner that the connection terminal portions 132 are bent so that they can be made to be parallel to the break portion 128 and they are separated from each other. One connection terminal portion 132 is connected to a positive terminal 10*b* of the battery 10 shown in FIG. 1, and the other terminal portion 132 is connected to a fusible link 14. In this connection, when the break portion 128 is inserted, a gap may be formed between the inner seal 124 and the break portion 128.

This electric path 121 is inserted into the inner case 124 from the break portion 128 side. The flange 127 of the inner case 124 is interposed between the connection terminal sections 132 and the opening edge of the case body 123. The electric path 121 is inserted into the case 120 until the connection terminal portions 132 come into contact with the flange 127 of the inner case 124. The inside of the case 120 is partitioned into the opening side and the bottom side by the break portion 128 which is arranged along the inside shape of the inner case 124 (shown in FIG. 11).

The ignition part 122 is composed in such a manner that a predetermined quantity of gunpowder 133 and the filament to heat the gunpowder 133 are arranged in the attaching hole 135 of the resin member 134. The filament is connected to harness ECU 17 shown in FIG. 1 via the lead wire 136. Electric current is turned on and the filament is heated according to a control signal of this harness ECU 17.

Examples of the gunpowder 133 housed in the ignition part 122 are: an explosive having the ignition property, gunpowder, and explosive used for a detonator. In order to break the break portion 128 of the electric path 121 effectively, it is preferable that the gunpowder 133 contains metal. A specific example of the gunpowder 133 is potassium perchlorate ($KClO_4$) which contains metal, the ignition sensitivity of which is high, wherein fluorocarbon rubber or cellulose nitrate is used as binder. Examples of the metal are: (1) at least one metal selected from the metal element group of B, Ti, Fe, Co, Ni, Cu, Zn, Al, Si, Ga, Ge, Sn, Mo, Zr and W, wherein oxide of the above metal is stable; (2) at least one alloy selected from the alloy-group consisting of alloys made of B, Ti, Fe, Co, Ni, Cu, Zn, Al, Si, Ga, Ge, Sn, Mo, Zr and W; (3) and at least one metal selected from the metal element group of B, Ti, Fe, Co, Ni, Cu, Zn, Al, Si, Ga, Ge, Sn, Mo, Zr and W, and also at least one alloy selected from the alloy group consisting of alloys made of B, Ti, Fe, Co, Ni, Cu, Zn, Al, Si, Ga, Ge, Sn, Mo, Zr and W. One of the metals described in the above items (1) to (3) functions as a metal jet in the case of ignition, so that the break portion can be positively broken. The metal to be used is made to be particles, the size of which is appropriate, or powder. In this connection, the single body of a metal element and the alloy of the single bodies of metal elements are not necessarily pure, but they may contain inevitable impurities in the process of refinement. That is, it is possible to use a single body of metal element and alloy of the single bodies of metal elements which can be commonly obtained on the market.

When the gunpowder 133 is ignited by the heating of the filament, it is melt or burned. The thus melt or burned metal is blown off by an explosive force. Therefore, the melt or burned metal can be utilized as a metal jet for breaking the break portion 128 of the electric path 121.

The resin member 134 is inserted into the U-shape of the electric path 121 along the inside of the inner case 124 from the opening end side of the case body 123, and comes into contact with the break portion 128 of the electric path 121. Due to the above arrangement, the attaching hole 135 of the resin member 134, in which the gunpowder 133 is arranged, is closed by the break portion 128 on the ignition point "a" side of the gunpowder 133. Therefore, a tightly closed space S is formed between the ignition point "a" and the break groove 130 of the break portion 128. In this connection, if the explosive force of the gunpowder 133 can be concentrated upon the break portion 128, a gap may be formed, by which the tightly closed space S is open onto the break portion 128 side. However, it is preferable that the gap is not more than 1 percent of the entire surface area of the tightly closed space S.

Figure 13:
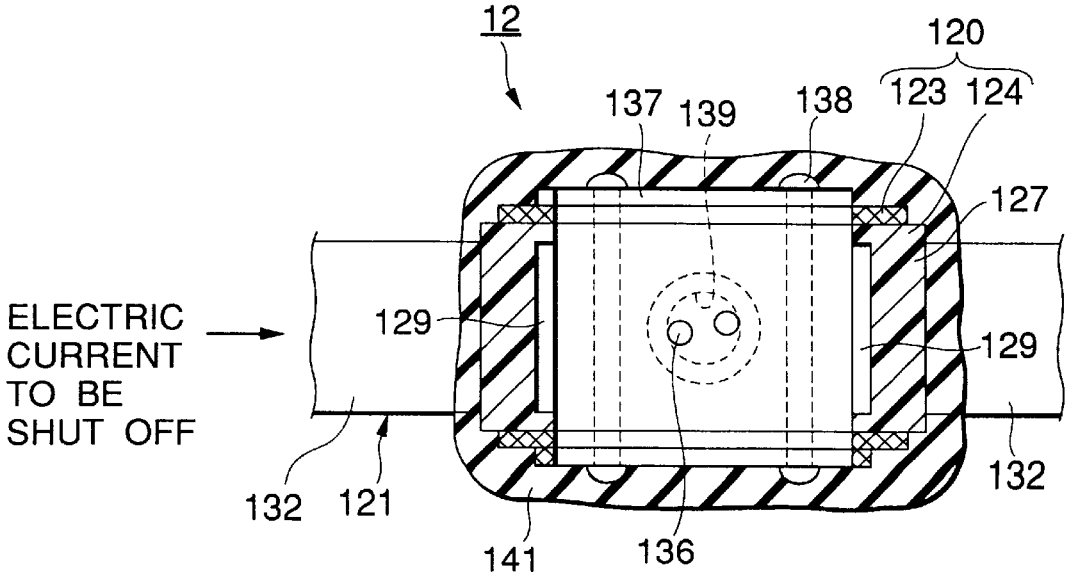
FIG. 13 is a view of the circuit breaker of the fourth embodiment, wherein the view is taken along line D—D in FIG. 11.

As shown in FIG. 13, the ignition part 122 is fixed to the case body 123 by the support bracket 137, which surrounds the outside of the case body 123 and is inserted into the U-shape of the electric path 121 from the lead wire 136 side, and also fixed by a plurality of rivets 138 penetrating the support bracket 137, case 120 and resin member 134 in this order. In the support bracket 137, there is formed a guide hole 139 for guiding the lead wire 136 to the outside of the resin member 134. Due to the above arrangement, the ignition part 122 can be prevented from jumping out from the case 120 by the support bracket 137 and the rivets 138 when an explosive force of the gunpowder 133 is given to the ignition part 122. In this way, the mechanical strength of the circuit breaker can be ensured in the case of ignition.

Concerning the electric path 121 and the ignition part 122 housed in the case 120, packing 140 is arranged in the engaging portions between the inner case 124 and the electric path 121, between the electric path 121 and the resin member 134 and also between the inner case 124 and the resin member 134, so that the tightness of the tightly closed space S can be enhanced. Further, when the overall surface on the opening end side of the case body 123 is subjected to resin molding 141, the tightness of the tightly closed space S can be enhanced.

Figure 14:
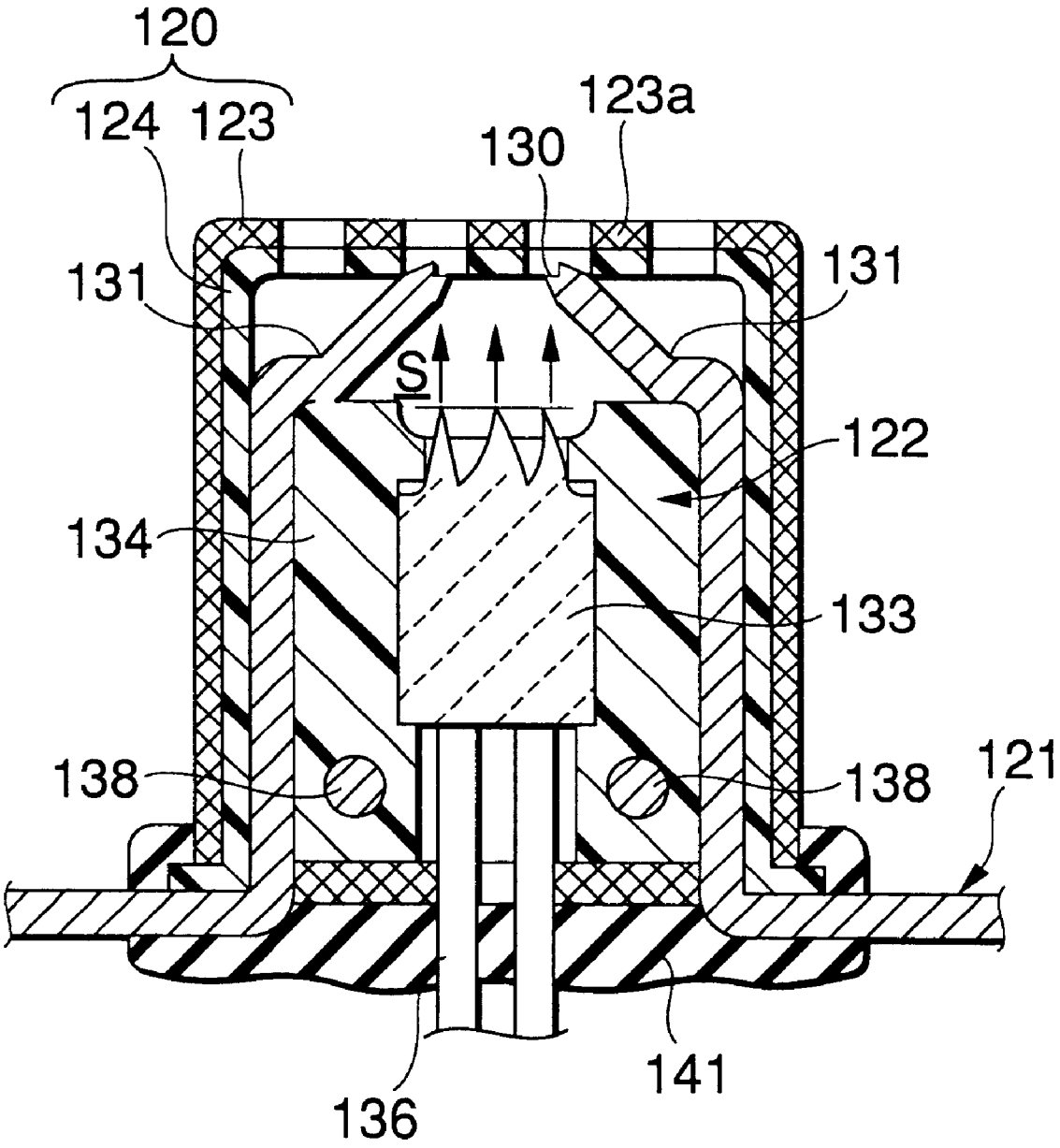
FIG. 14 is a schematic illustration showing a state in the case of shutting off the circuit breaker shown in FIG. 11.

Next, referring to FIGS. 1 and 14, operation of the circuit breaker 12 of the fourth embodiment is described below.

When an air bag signal is made by a vehicle collision in FIG. 1 and inputted into harness ECU 17, electric power is supplied to the circuit breaker 12 by harness ECU 17 via the lead wire 136, that is, the circuit breaker 12 is energized by harness ECU 17. When the circuit breaker 12 is supplied with electric power, the filament of the ignition part 122 is heated as shown in FIG. 14 and the gunpowder 133 is ignited and exploded. This explosive force is concentrated upon the break portion 128 from the tightly closed space S, and metal, which is burned by the ignition of the gunpowder 133, is also blown to the break portion 128. Therefore, the break portion 128 is broken at the break groove 130, and at the same time, the break portion 128 is opened in such a manner that it protrudes to the bottom 123*a* side of the case body 123 while each bent groove 131 is used as a fulcrum as shown in FIG. 14. Due to the foregoing, the electric power supply circuit (shown in FIG. 1), into which the electric path 121 having the break portion 128 is incorporated, is forcibly shut off, and electric power supply to almost all electric equipment except for some of electric equipment is simultaneously shut off and the safety can be guaranteed after the vehicle collision.

Since the tightness of the tightly closed space S is enhanced by the engaging structure of the case 120, electric path 121 and ignition part 122 and also by the packing 140 and resin mold 141, there is no possibility that air and metal are jetted out from the opening side of the case 120 by the explosive force generated in the tightly closed space S. Accordingly, it is possible to concentrate all explosive force upon the break portion 128 of the electric path 121, and the break portion 128 can be positively broken.

The resin member 134 of the ignition part 122 is held in the case 120 by the support bracket 137 and the rivets 138 with resisting the explosive force. Therefore, the circuit breaker 12 is not damaged by explosion.

[Fifth embodiment]

Referring to FIGS. 15 to 19, a fifth embodiment of the present invention will be explained below. The circuit breaker 12 of this embodiment includes: a circuit breaker body 210 having a circuit shutoff function; and a path forming member 220 connected to the circuit breaker body 210.

The circuit breaker body 210 includes: a squib holding section 213 for holding a squib 212 (an ignition part); and a case 214 for covering the squib holding section 213 from the outside. The case 214 is composed of an inner case 214*a* made of insulating material such as synthetic resin, and an outer case 214*b* made of metal for covering the inner case 214*a* from the outside. A bus bar 216 is interposed between the inner case 214*a* and the squib holding section 213.

The squib 212 houses gunpowder. In the case of emergency such as a vehicle collision, the squib 212 receives an electric signal from a control unit (not shown) via lead wire 230. Due to the foregoing, the gunpowder is exploded, and the explosive force is outputted to the front, that is, the explosive force is outputted to the left in FIGS. 16A and 16B.

The bus bar 216 is a conductor for composing an electric power supply circuit and connects a battery with a circuit arranged on the electrical equipment side. An intermediate portion of the bus bar 216 is incorporated into the case 214, and both end portions 216*a*, 216*b* are guided outside the case so as to form a connecting terminal section. The intermediate portion of the bus bar 216 is located in the front portion of the squib 212 and provided with a break section 218 to be broken by an explosive force outputted by the squib 212. In the example shown in the figure, the wall thickness of this break section 218 is locally reduced, so that the break section 218 can be more easily broken than other portions.

On a side wall of the case 214 located in the further front of the above break section 218, there are provided a plurality of gas discharge ports 219. Gas generated in the case 214 by the explosion is discharged outside the case 214 from this gas discharge ports 219.

The circuit breaker 12 of the fifth embodiment is provided with a path forming member 220 which is attached to the case 214.

This path forming member 220 includes: a substantially rectangular cylindrical case attaching section 221 which covers from the front side (the left in FIGS. 16A to 17) of the case 214; and a path forming section 222 extending downward from the front end of this case attaching section 221.

At the rear end each of the upper and down walls of the case attaching section 221, there is provided a step section 223 which is more protruded outside than other sections. Also, at the rear end each of the upper and down surfaces of the case 214, there is provided a step section 215 which is more protruded outside than other sections. When these step sections 223, 215 are fastened to each other by rivets 226 under the condition that the step section 223 is externally engaged with the step section 215, the path forming member 220 can be connected to the case 214.

The path forming section 222 is entirely filled with the porous body (meshes made of metal in this example) 224 in the longitudinal direction. This porous body 224 is arranged in such a manner that the upper end section is opposed to the gas discharge ports 219 of the case 214 and that the lower end section is fastened to a lower end section of the path forming section 222 by rivets 226. In the present invention, the unit for fixing the porous body to the path forming member and the unit for fixing the path forming member to the case are not limited to the rivets, but the well-known units such as screws or welding can be applied.

Figure 18:
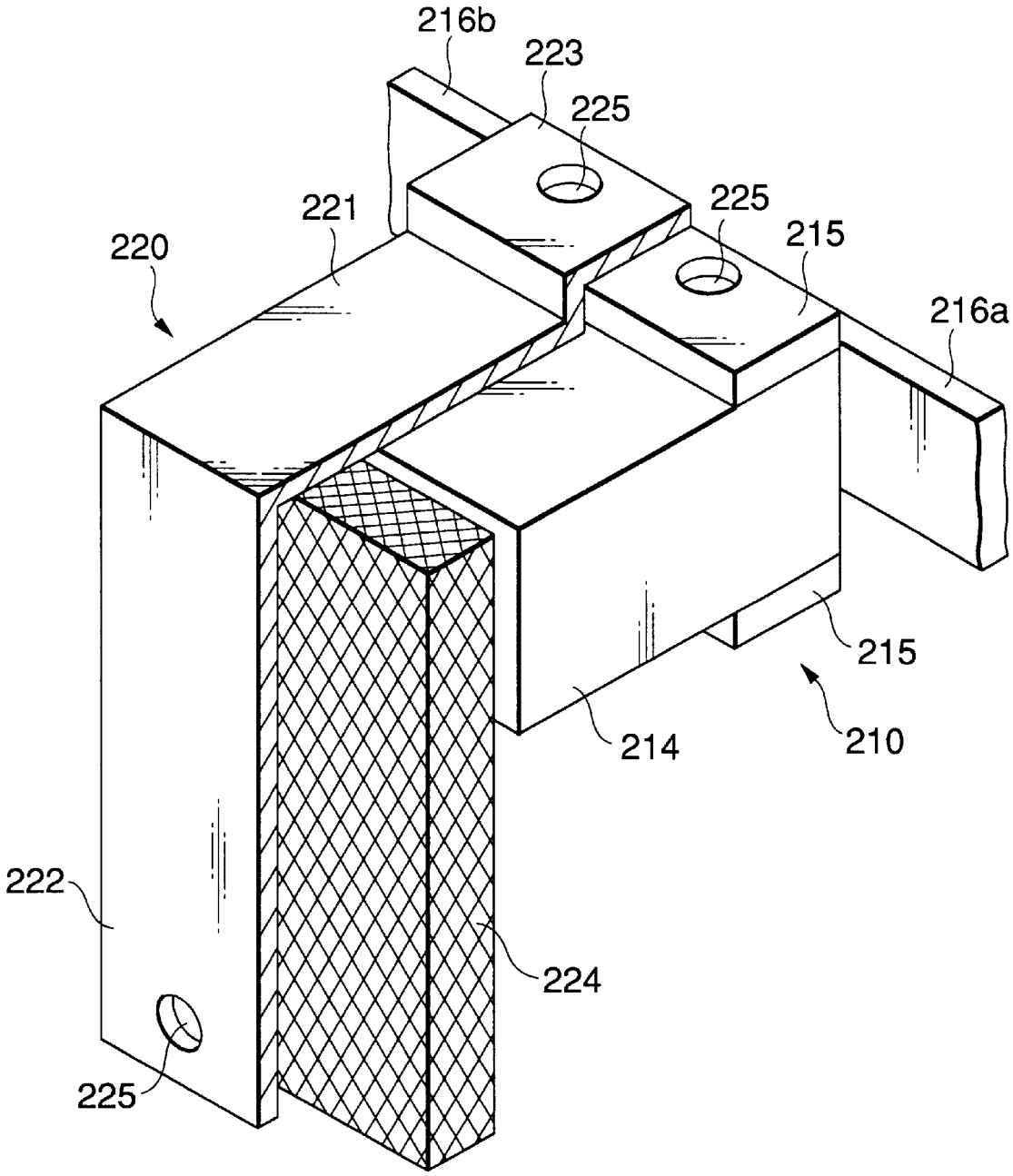
FIG. 18 is a partially cross-sectional perspective view of the circuit breaker of the fifth embodiment, wherein the view is taken from the front side.
Figure 19:
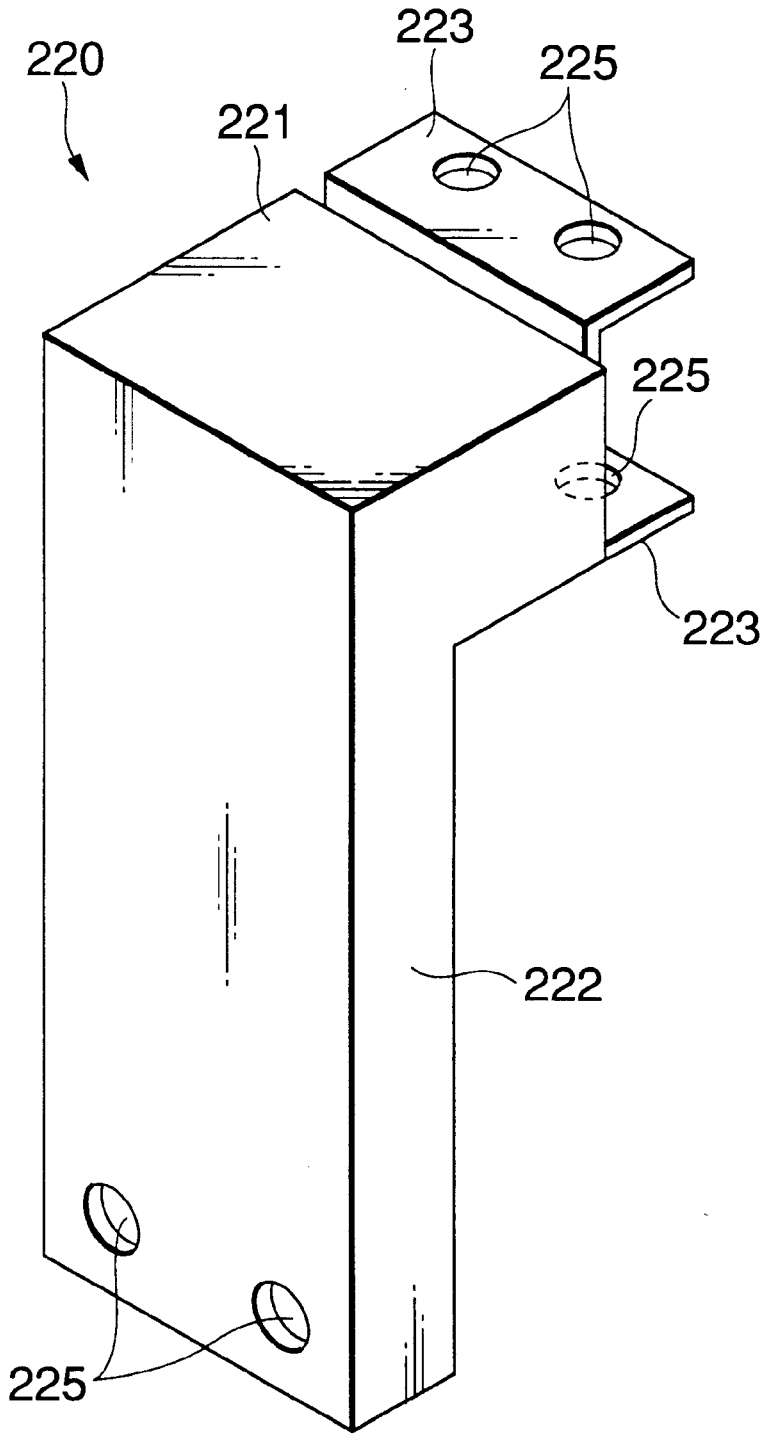
FIG. 19 is a cross-sectional perspective view of the path forming member of the circuit breaker of the fifth embodiment.

In FIG. 18, reference numerals 225 are through holes formed at appropriate positions into which rivets 226 are attached.

Here, the mechanism of suppressing the propagation of a flame according to the fifth embodiment having a porous body will be described as follows.

(1) Quenching a flame by a solid wall

Figure 21:
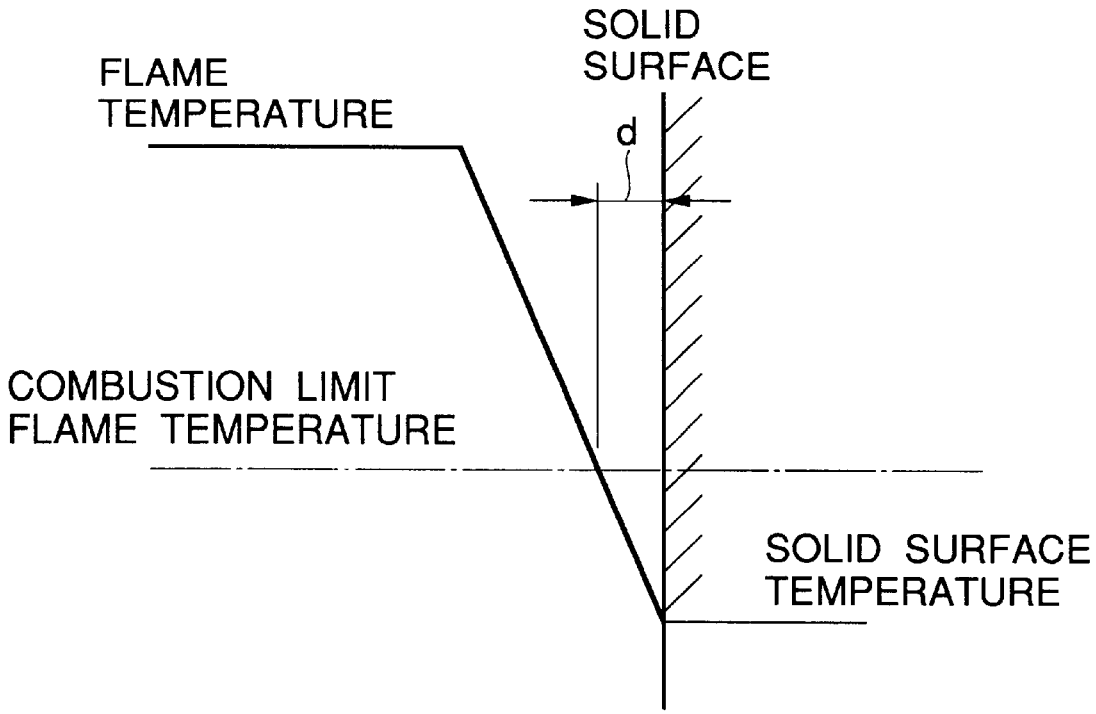
FIG. 21 is a schematic illustration showing a temperature gradient when a flame is propagated toward a solid wall.

When a solid wall exists at a position to which the flame is propagated as shown in FIG. 21, there is a remarkable difference between the flame temperature and the temperature of the solid surface. Accordingly, a remarkably high gradient of temperature is caused between the flame and the solid wall. A combustion limit flame temperature exists between both temperatures. Accordingly, in a region, the temperature of which is lower than this combustion limit flame temperature, that is, in a region, the distance from the solid surface of which is not more than a predetermined value "d", the flame can not be propagated. Therefore, the flame is quenched in the region. This region is a dead space. Size "d" of this dead space is determined by the combustion condition. Accordingly, when a gap, which is smaller than the size (quenching distance) corresponding to size "d", is formed, it is impossible for the flame to propagate through this gap. Consequently, when a porous body having a large number of small holes are provided in the gas exhaust path, it is possible to suppress the propagation of a flame to the outside of the circuit breaker while gas generated in the case is quickly released. For the above reasons, the diameters of the holes formed in the porous body relating to the present invention are preferably small, that is, it is preferable that the diameters of the holes formed in the porous body are several microns.

(2) Drop in generated pressure

The higher the pressure is, the more intense the combustion becomes. Especially when gunpowder is used, a remarkably high pressure is generated by the explosion. However, when the gas discharge path is provided like the arrangement of the present invention and the porous body, through which gas can easily pass, is arranged in this gas discharge path, it is possible to quickly lower the gas pressure in the case by releasing the gas from the case. Therefore, in addition to the above effect described in item (1), it is possible to effectively suppress the propagation of a flame. The present inventors confirmed that about 98% of generated gas can be instantly released from the case to the outside especially when the porous body is composed of meshes made of metal. Due to the foregoing, it is possible to provide a higher combustion suppression effect.

(3) Absorption of heat by a porous body

Since the surface area of a porous body is very large, it is possible to lower the temperature of a flame effectively. Especially when the porous body is composed of meshes made of metal, the heat conductivity of which is high, it is possible to lower the combustion temperature effectively and suppress the combustion.

The structure of the porous body described in the present invention is not limited to meshes, but it is possible to use a honey comb structure or a continuous foaming structure. The material is not limited to metal, but it is possible to use ceramics, heat-resistant fiber or heat-resistant resin.

Next, operation of this circuit breaker will be explained below.

This circuit breaker is incorporated into an electric power supply circuit of a vehicle under the condition that one 216*a* of the connection terminals of the bus bar 216 is connected onto the battery side and the other connection terminal 216*b* of the bus bar 216 is connected onto the electric equipment side, wherein the electric equipment is mounted on the vehicle. Immediately after the circuit breaker has been set in the vehicle, that is, when the vehicle is in a normal condition in which no traffic accident such as a vehicle collision has occurred, electric power is supplied from the battery not shown in the drawing to the electric equipment via the bus bar 216.

When an abnormal condition such as a vehicle collision is detected, a control signal is inputted from the control unit not shown in the drawing into the squib 212 via lead wire 230. Therefore, the squib 212 is operated and gunpowder housed in the squib 212 is exploded. The break portion 218 of the bus bar 216 is broken by the explosive force, and the circuit into which the bus bar 216 is incorporated is shut off in emergency. In this case, gas and flames generated in the explosion try to get outside the case 214 from the gas discharge port 219. Generated gas is quickly discharged downward from a lower end of the path forming section 222 via the gaps of the porous body 224 made of metallic meshes. Due to the foregoing, pressure in the case 214 is quickly reduced, however, the propagation of flames is suppressed by the action of the porous body 224. Therefore, the flames are prevented from dispersing from the lower end of the path forming section 222. Although the structure of this circuit breaker is compact, it is possible to ensure the high safety of shutoff operation.

[Sixth Embodiment]

Figure 20:
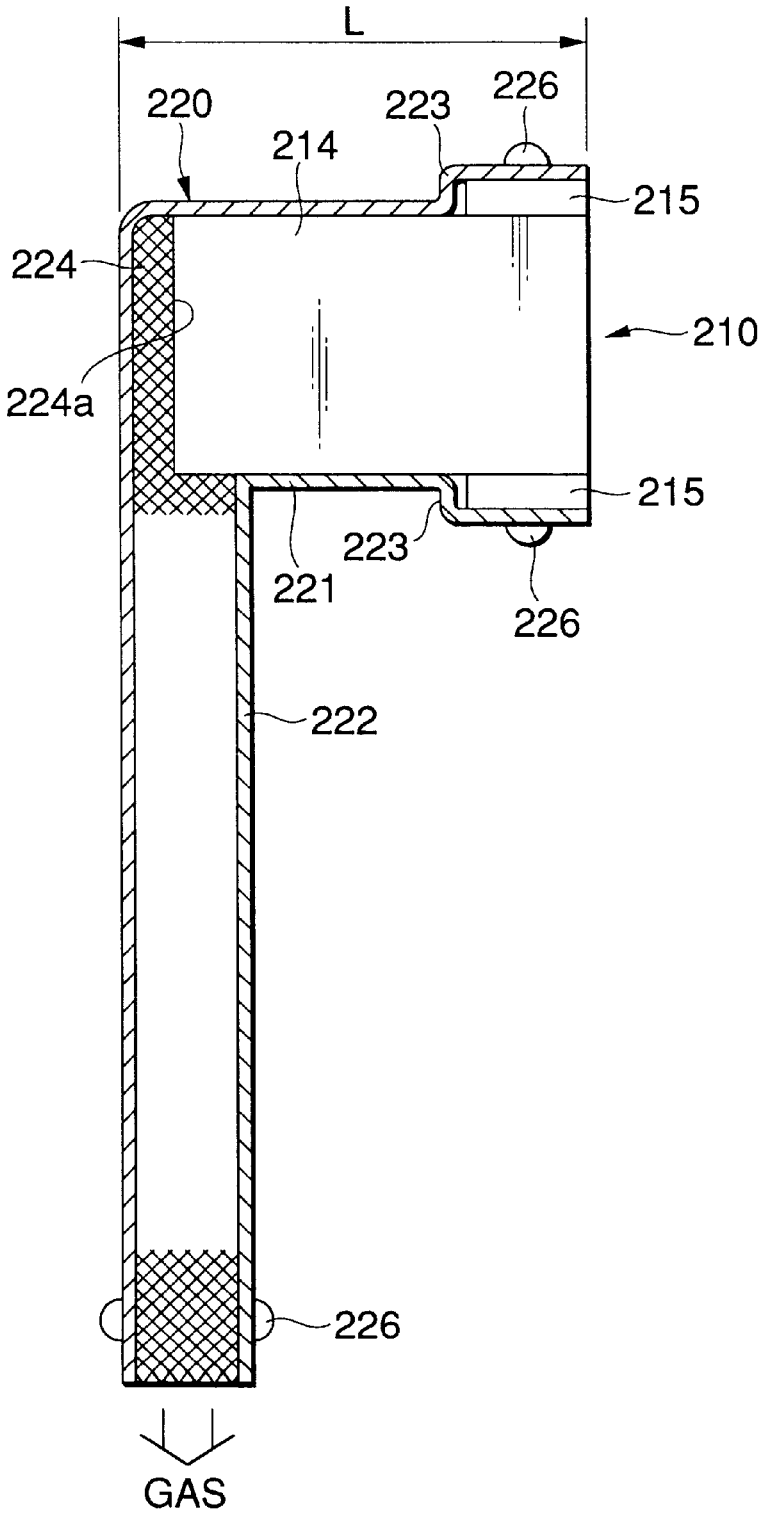
FIG. 20 is a cross-sectional side view showing the circuit breaker of the sixth embodiment of the present invention.

FIG. 20 is a view showing the sixth embodiment. In this embodiment, an upper rear end surface of the porous body 224 described in the fifth embodiment is cut out, so that a recess 224*a* is formed. A front end portion of the case 214, that is, an end portion of the case 214 at which the gas discharge port 219 is formed is engaged in this recess 224*a*.

Due to the above arrangement, while the total length of the porous body 224 is kept long so that a sufficiently high function of preventing the propagation of flames can be ensured, it is possible to reduce total length L of the circuit breaker in the longitudinal direction by the length in which the case 214 is engaged in the recess 224*a*. Therefore, the size of the overall circuit breaker can be reduced.

In this connection, in the fifth and sixth embodiments, the following modifications can be adapted.

(1) In the fifth and sixth embodiments of the present invention, it is sufficient that the length of the gas discharge path is long enough to fill the porous body in it. Therefore, the length of the gas discharge path can be appropriately determined in a range in which the propagation of flames can be prevented. When the gas discharge path is formed in such a manner that it extends in a direction perpendicular to the flame propagating direction from the gas discharge port 219, it is possible to effectively prevent the flames from dispersing outside with the gas discharge path as short as possible. Further, the above arrangement is advantageous in that the direction of the exit of the path can be freely determined. For example, when the gas discharge path is set downward as shown in the drawing so that the position of the discharge port can be lowered as low as possible, it is possible to more positively prevent a very small quantity of hydrogen gas rising from the battery, the specific gravity of which is low, from getting into the path forming section 222.

(2) The porous body 224 may be arranged only in a portion of the gas discharge path in the longitudinal direction.

Figure 15:
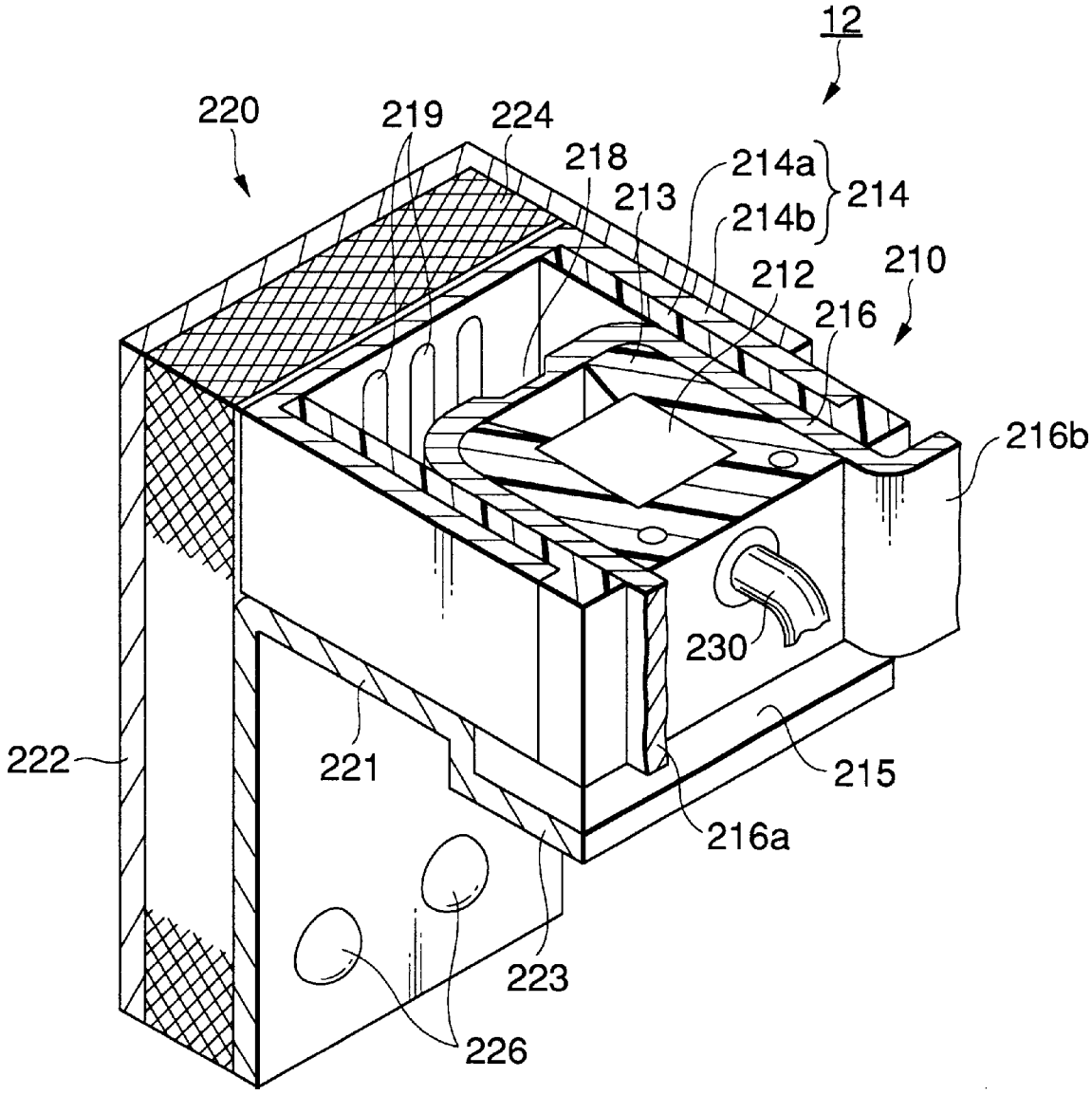
FIG. 15 is a partially cross-sectional perspective view of the circuit breaker of the fifth embodiment of the present invention, wherein the view is taken from the rear side.
Figure 16A:
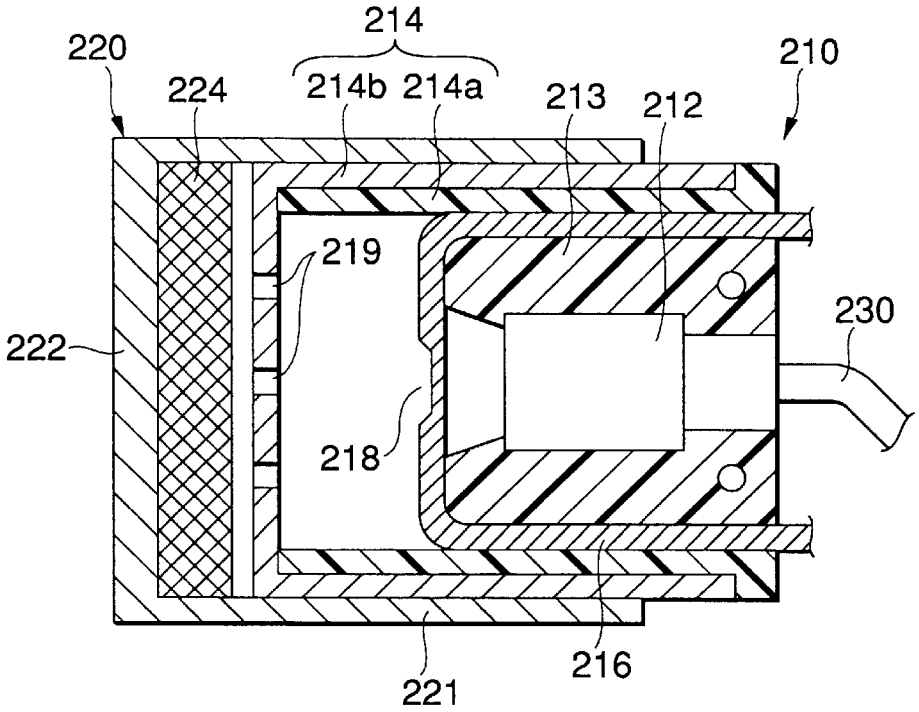
FIG. 16A is a cross-sectional plan view showing a state before the circuit breaker of the fifth embodiment is shut off.
Figure 16B:
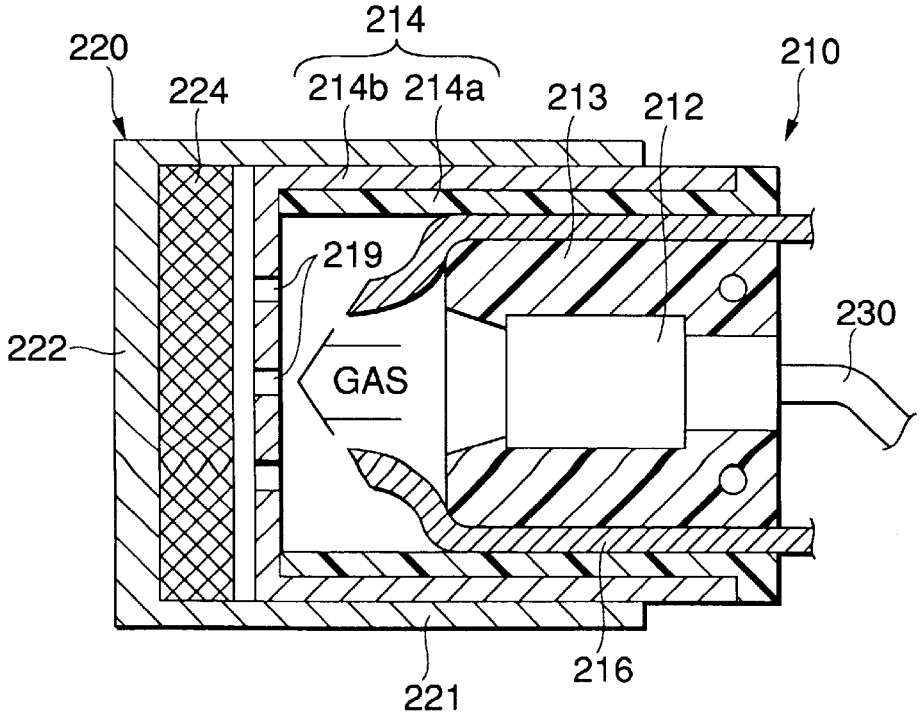
FIG. 16B is a cross-sectional plan view showing a state after the above circuit breaker has been shut off.
Figure 17:
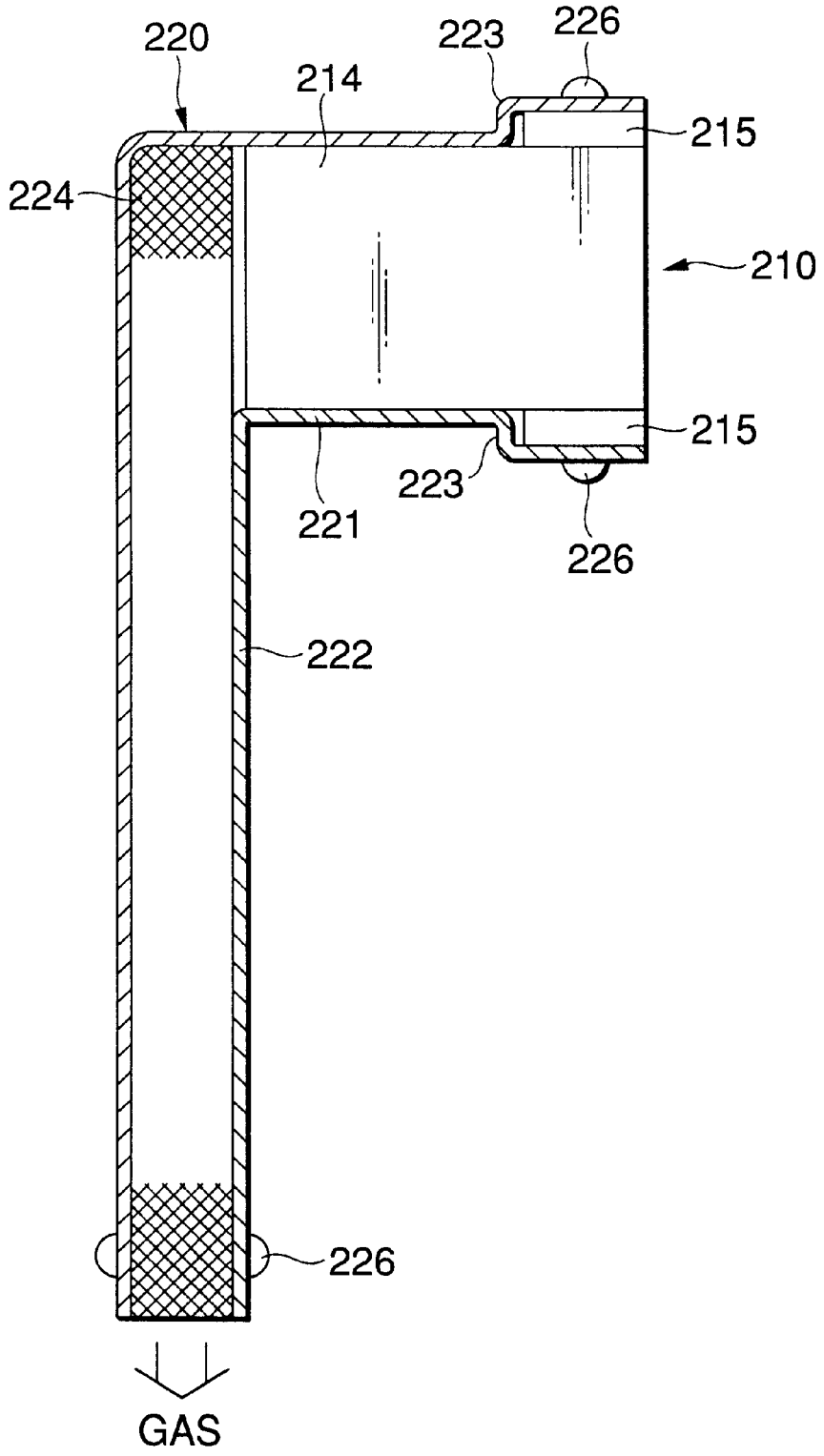
FIG. 17 is a cross-sectional side view showing the circuit breaker of the fifth embodiment.

(3) In the fifth and sixth embodiments of the present invention, a member to form the gas discharge path may be integrated into one body with the case. Alternatively, as shown in FIG. 15, the path forming member 220, which is different from the case 214, may be attached to the case 214. The former arrangement is advantageous in that the number of parts can be reduced. Also, in this arrangement, it is preferable that the gas discharge path is extended in a direction perpendicular to the gas generating direction. The latter arrangement is advantageous in that the existing case 214 can be used and further the porous body 224 can be easily filled into the gas discharge path. Furthermore, when the porous body 224 is opposed to the gas discharge port 219 of the case 214 as shown in the drawing so as to disperse the pressure of generated gas by the porous body 224, it is possible to reduce mechanical loads given to the path forming member 220 and the case 214. For example, it is possible to prevent the occurrence of a problem in which a gap is formed between the path forming member 220 and the porous body 224 by the deformation of the member 220.

[Example of the Fifth and Sixth Embodiments]

In the structure shown in FIGS. 15 to 19, the following porous body 224 was used. Length was 2.4 cm, width was 3.7 cm, thickness was 0.6 cm, and density was 2.6 g/cm$^3$. The porous body 224 was composed of metallic meshes, the diameter of the element wire of which was Φ0.26 mm. When the experiment was made in which the above structure was used, it was confirmed that the propagation of flames was completely shut off while the gas permeability was being maintained so that about 98% of air were made to pass through the porous body instantly. Even when the recess 224*a* shown in FIG. 20 was formed in an upper portion of the porous body 224 and the structure shown in the drawing was adopted, it was confirmed that the propagation of flames was completely shut off.

In the above embodiment, the circuit breaker is used for shutting off the circuit of an automobile, but it should be noted that the present invention is not limited to the above specific embodiments. That is, the present invention can be applied to a circuit breaker commonly used when a circuit is shut off in emergency. Further, in the fourth embodiment, the gunpowder 133 contains metal, however, as long as the break portion 128 (218) of the electric path 121 (bus bar 216) can be sufficiently broken, it is unnecessary for the gunpowder 133 to contain metal.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A circuit breaker, comprising:

a cylindrical portion having a gunpowder and an exploding means for exploding the gunpowder by application of electric power to the gunpowder, the cylindrical portion being provided with an opening at least one end;

a base material securing the cylindrical portion, at least the surface of which is made of insulating material, the base material defining a recessed portion;

a conductor fixed to the base material and having a break portion located at a position opposite to the opening of the cylindrical portion, the break portion being broken by explosive force of the gunpowder;

a first metallic cover portion covering the cylindrical portion and the break portion; and a second metallic cover portion covering the base material from an opposite side to the cylindrical portion engaged in the recessed portion of the base material, wherein the first and second cover portions are fixed to the base material by directly connecting the first and second cover portions to each other.

2. The circuit breaker according to claim 1, herein the first and second cover portions are integrally formed.

3. The circuit breaker according to claim 2, wherein the first cover portion has a pair of side walls, the second cover portion is composed of a pair of rolling portions extending from the side walls, and the first and second cover portions are fixed to the base material by rolling the rolling portions on the opposite side of the base material so that the rolling portions are lapped each other while interposing the base material.

4. The circuit breaker according to claim 1, wherein a recess portion accommodating the second cover portion is formed on the base material.

5. The circuit breaker according to claim 1, wherein insulating material is provided on the inside of the first cover portion.

6. The circuit breaker according to claim 1, wherein an inner surface of the first cover portion is coated with insulating material.

7. The circuit breaker according to claim 1, wherein a cover made of resin is molded so as to cover a connecting portion of the base material with each cover portion.

8. The circuit breaker according to claim 1, wherein the base material is made of one of aluminum and aluminum alloy, the surface of which is oxidized to form its oxide layer.

9. A circuit breaker according to claim 1, wherein the gunpowder contains metal.

10. A circuit breaker, comprising:

a cylindrical portion having a gunpowder and an exploding means for exploding the gunpowder by application of electric power to the gunpowder, the cylindrical portion being provided with an opening at least one end;

a base material securing the cylindrical portion, at least the surface of which is made of insulating material; and a conductor fixed to the base material and having a break portion located at a position opposite to the opening of the cylindrical portion, the break portion being broken by explosive force of the gunpowder; and a metal cover portion fixed to the base material so as to cover the cylindrical portion and the break portion, wherein the base material is made of one of aluminum and aluminum alloy, the base material has a surface in contact with the conductor, and the surface of the base material is oxidized to form an oxide layer that insulates the base material from the conductor.

11. The circuit breaker according to claims 10, wherein insulating material is provided on the inside of the cover portion.

12. The circuit breaker according to claim 10, wherein an inner surface of the cover portion is coated with insulating material.

13. The circuit breaker according to claim 10, wherein a cover made of resin is molded so as to cover a connecting portion of the base material with the cover portion.

14. A circuit breaker according to claim 10, wherein the gunpowder contains metal.

15. A circuit breaker, comprising:

an ignition part enclosing a gunpowder;

an electric path having a break portion broken by an explosive force of the gunpowder so as to shut off electric current applied thereon; and a resin member disposed between the ignition part and the electric path and contacting the break portion of the electric path, wherein a space formed among an ignition point of the ignition part, the break portion of the electric path and the resin member is tightly closed.

16. The circuit breaker according to claim 15, further comprising:

a case having the electric path and the ignition part, wherein the electric path is bent into a substantially U-shape so as to center the break portion, the electric path is fitted into the case along an inner surface of the case from the break portion side, and the ignition part is fitted into the U-shaped portion of the electric path and the case along the inner surfaces of the U-shaped portion and the case from the ignition point side of the ignition part, whereby a tightly closed space can be formed between the ignition part and the break portion such that the ignition point is opposed to the break portion.

17. The circuit breaker according to claim 16, wherein the U-shaped portion of the electric path is formed into the same shape as that of the inside of the case.

18. The circuit breaker according to claim 16, wherein a packing member for tightly closing the tightly closed space is provided in at least one of portions in which the case, electric path and ignition part are fitted with each other.

19. The circuit breaker according to claim 15, wherein the gunpowder of the ignition part includes metal.

20. The circuit breaker according to claim 19, wherein the metal is made of at least one material selected from at least one of a first group and a second group, the first group consisting of metal element of B, Ti, Fe, Co, Ni, Cu, Zn, Al, Si, Ga, Ge, Sn, Mo, Zr and W, the second group consisting of an alloy made of B, Ti, Fe, Co, Ni, Cu, Zn, Al, Si, Ga, Ge, Sn, Mo, Zr and W.

21. A circuit breaker according to claim 15, wherein the gunpowder contains metal.

22. A circuit breaker comprising:

a case accommodating a conductor for composing a circuit, the conductor being broken by an explosive force of a gunpowder so as to forcibly shut off the circuit;

a gas discharge path discharging gas generated by the explosion from the case to the outside of the circuit breaker; and a porous body filled in the gas discharge path and suppressing the propagation of a flame while it allows gas to pass through wherein the gas discharge path has a longitudinal portion extending in a direction substantially perpendicular to the direction of gas generation in the explosion and at least a part of the longitudinal portion is filled with the porous body.

23. The circuit breaker according to claim 22, wherein the porous body is composed of metallic meshes.

24. The circuit breaker according to claim 22, wherein the porous body is filled in a substantially entire region of the longitudinal portion of the gas discharge port.

25. The circuit breaker according to claim 22, wherein a gas discharge port is formed on the case, the gas discharge path is composed of a substantially cylindrical path forming member having a longitudinal portion extending from the gas discharge port to a direction substantially perpendicular to a direction which gas is discharged, and attached to the case so as to close the gas discharge port, and at least a part of the longitudinal portion is filled with the porous body.

26. The circuit breaker according to claim 25, wherein the porous body is filled at a position opposed to the gas discharge port.

27. The circuit breaker according to claim 25, wherein the porous body is filled in a substantially entire region of the longitudinal portion of the gas discharge port.

28. The circuit breaker according to claim 26, wherein the porous body is filled in a substantially entire region of the longitudinal direction of the gas discharge port, the porous body is defined with a recess fitting an end portion of the case on the side, on which the gas discharge port is arranged.

29. A circuit breaker according to claim 22, wherein the gunpowder contains metal.

30. A circuit breaker, comprising:

a cylindrical portion having a gunpowder and an exploding means for exploding the gunpowder by application of electric power to the gunpowder, the cylindrical portion being provided with an opening at at least one end;

a base material securing the cylindrical portion, at least the surface of which is made of insulating material;

a conductor fixed to the base material and having a break portion located at a position opposite to the opening of the cylindrical portion, the break portion being broken by explosive force of the gunpowder;

a first metallic cover portion covering the cylindrical portion and the break portion, the first metallic cover portion having a pair of side walls; and a second metallic cover portion covering the base material from an opposite side to the cylindrical portion, the second metallic cover portion having a pair of rolling portions extending from the side walls of the first metallic cover portion, wherein the first and second cover portions are integrally formed and fixed to the base material by rolling the rolling portions on the opposite side of the base material so that the rolling portions are lapped each other while interposing the base material.

* * * * *